US011297428B2

(12) United States Patent
Sakuraba

(10) Patent No.: US 11,297,428 B2
(45) Date of Patent: Apr. 5, 2022

(54) SOUND PROCESSING DEVICE, SOUND PROCESSING METHOD, AND PROGRAM

(71) Applicant: SONY CORPORATION, Tokyo (JP)

(72) Inventor: Yohei Sakuraba, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/980,765

(22) PCT Filed: Mar. 15, 2019

(86) PCT No.: PCT/JP2019/010756
§ 371 (c)(1),
(2) Date: Sep. 14, 2020

(87) PCT Pub. No.: WO2019/188388
PCT Pub. Date: Oct. 3, 2019

(65) Prior Publication Data

US 2021/0014608 A1 Jan. 14, 2021

(30) Foreign Application Priority Data

Mar. 29, 2018 (JP) ..... JP2018-063529

(51) Int. Cl.
*H04R 3/00* (2006.01)
*H04R 29/00* (2006.01)
(Continued)

(52) U.S. Cl.
CPC ..... *H04R 3/02* (2013.01); *H04R 1/326* (2013.01); *H04R 29/00* (2013.01)

(58) Field of Classification Search
CPC . H04R 3/00; H04R 3/02; H04R 3/005; H04R 3/12; H04R 29/00; H04R 29/001; H04R 29/004; H04R 1/32; H04R 1/326
See application file for complete search history.

(56) References Cited

U.S. PATENT DOCUMENTS 5,303,304 A * 4/1994 Lee ..... G11B 31/006 348/373
6,195,437 B1 * 2/2001 Markow ..... H04M 1/6033 379/388.03

(Continued)

FOREIGN PATENT DOCUMENTS

CN 103813239 A 5/2014
JP 2004-343700 A 12/2004

(Continued)

OTHER PUBLICATIONS

International Search Report dated Jun. 4, 2019 in PCT/JP2019/010756 filed on Mar. 15, 2019, 2 pages.

*Primary Examiner* — Thang V Tran
(74) *Attorney, Agent, or Firm* — Oblon, McClelland, Maier & Neustadt, L.L.P.

(57) ABSTRACT

A sound processing device program that enables a sound signal adapted to an intended use to be output is provided. The sound processing device includes a signal processing part that processes a sound signal picked up by a microphone, and generates a recording sound signal to be recorded in a recording device, and generates an amplification sound signal different from the recording sound signal to be output from a speaker. The sound processing device can be applied to, for example, a sound amplification system that performs off-microphone sound amplification.

18 Claims, 19 Drawing Sheets

(51) Int. Cl.
*H04R 3/02* (2006.01)
*H04R 1/32* (2006.01)

(56) References Cited

U.S. PATENT DOCUMENTS

2004/0165735 A1 8/2004 Opitz
2006/0222188 A1* 10/2006 Asakawa ..... H04R 3/02 381/94.1
2011/0142253 A1* 6/2011 Hata ..... H04R 1/406 381/92
2012/0257764 A1* 10/2012 Sung ..... H04R 1/1083 381/74
2013/0322649 A1* 12/2013 Sakuraba ..... H03G 3/20 381/94.2
2013/0322654 A1* 12/2013 Okabayashi ..... H04R 27/00 381/119
2014/0133666 A1 5/2014 Tanaka et al.
2014/0161272 A1* 6/2014 Marquis ..... G10L 21/0208 381/71.7
2015/0104039 A1* 4/2015 Lee ..... G10L 21/0208 381/93
2016/0192073 A1* 6/2016 Poornachandran ..... H04R 5/04 381/26
2016/0381457 A1 12/2016 Tanaka et al.

FOREIGN PATENT DOCUMENTS

JP 2011-523836 A 8/2011
JP 2011-528806 A 11/2011
JP 2013-141118 A 7/2013
JP 2014-116932 A 6/2014
JP 2015-76659 A 4/2015

* cited by examiner

FIG. 14

| | SOUND SNEAKING AMOUNT | BEAMFORMING SUPPRESSION AMOUNT | SCORE | SOUND QUALITY |
|---|---|---|---|---|
| CASE A | 6dB | −12dB | −6dB | LOW |
| CASE B | 6dB | −18dB | −12dB | MIDDLE |
| CASE C | 0dB | −12dB | −12dB | MIDDLE |
| CASE D | 0dB | −18dB | −18dB | HIGH |

SOUND PROCESSING DEVICE, SOUND PROCESSING METHOD, AND PROGRAM

TECHNICAL FIELD

The present technology relates to a sound processing device, a sound processing method, and a program, and in particular, to a sound processing device, a sound processing method, and a program that enable a sound signal adapted to an intended use to be output.

BACKGROUND ART

In a system including a microphone, a speaker, and the like, various parameters are adjusted by performing calibration before use, in some cases. There is known a technology of outputting a calibration sound from a speaker when performing this type of calibration (for example, see Patent Document 1).

Furthermore, Patent Document 2 discloses a communication device that outputs a received sound signal from a speaker and transmits a sound signal picked up by a microphone, with respect to an echo canceller technology. In this communication device, sound signals output from different series are separated.

CITATION LIST

Patent Document

Patent Document 1: Japanese Patent Application National Publication (Laid-Open) No. 2011-523836

Patent Document 2 Japanese Patent Application National Publication (Laid-Open) No. 2011-528806 (Japanese Patent No. 5456778)

SUMMARY OF THE INVENTION

Problems to be Solved by the Invention

By the way, in outputting a sound signal, in a case where an output of a sound signal adapted to an intended use is required, only adjusting the parameters simply by calibration or dividing the sound signals output from different series is not sufficient for obtaining a sound signal adapted to an intended use. Therefore, there is a demand for a technology for realizing a sound signal output adapted to an intended use.

The present technology has been made in view of such a situation, and is intended to enable a sound signal adapted to an intended use to be output.

Solutions to Problems

A sound processing device according to a first aspect of the present technology includes a signal processing part that processes a sound signal picked up by a microphone, and generates a recording sound signal to be recorded in a recording device and an amplification sound signal different from the recording sound signal to be output from a speaker.

A sound processing method and a program according to the first aspect of the present technology are a sound processing method and a program corresponding to the above-described sound processing device according to the first aspect of the present technology.

In the sound processing device, the sound processing method, and the program according to the first aspect of the present technology, a sound signal picked up by a microphone is processed, and a recording sound signal to be recorded in a recording device and an amplification sound signal different from the recording sound signal to be output from a speaker are generated.

A sound processing device according to a second aspect of the present technology is a sound processing device including a signal processing part that performs processing for, when processing a sound signal picked up by a microphone and outputting the sound signal from a speaker, reducing sensitivity in an installation direction of the speaker as directivity of the microphone.

In the sound processing device according to a second aspect of the present technology, processing for, when processing a sound signal picked up by a microphone and outputting the sound signal from a speaker, reducing sensitivity in an installation direction of the speaker as directivity of the microphone is performed.

Note that the sound processing device according to the first aspect and the second aspect of the present technology may be an independent device, or may be an internal block included in one device.

Effects of the Invention

According to a first aspect and a second aspect of the present technology, it is possible to output a sound signal adapted to an intended use.

Note that the effects described herein are not necessarily limited, and any of the effects described in the present disclosure may be applied.

BRIEF DESCRIPTION OF DRAWINGS

FIG. 14 is a diagram showing an example of calculation of a sound quality score.

MODE FOR CARRYING OUT THE INVENTION

Figure 1:
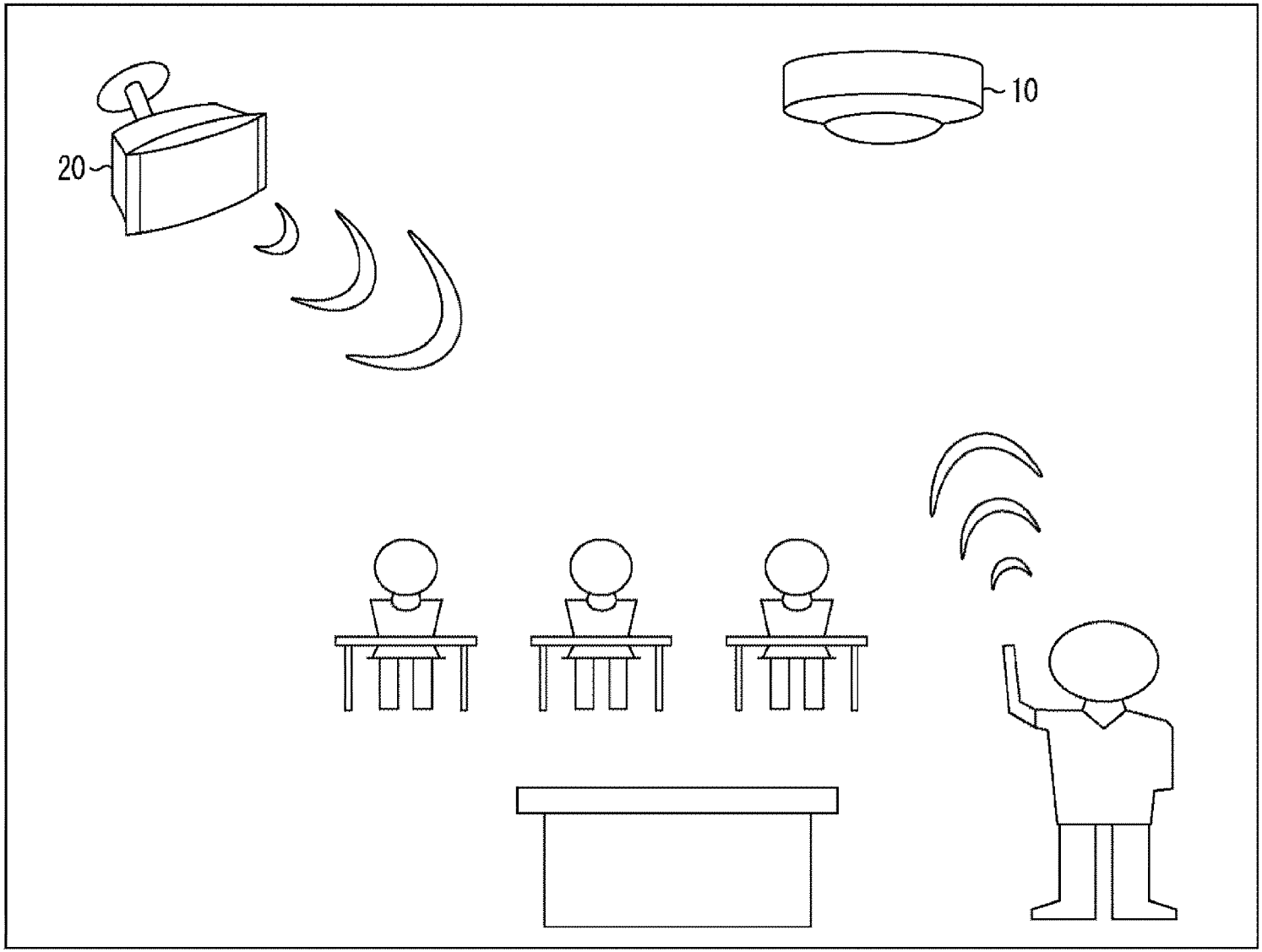
FIG. 1 is a diagram showing an example of installation of a microphone and a speaker to which the present technology is applied.

Hereinafter, embodiments of the present technology will be described with reference to the drawings. Note that the description will be given in the following order.

1. Embodiment of present technology
(1) First embodiment: basic configuration
(2) Second embodiment: configuration in which calibration is performed at the time of setting
(3) Third embodiment: configuration in which calibration is performed at the start of use
(4) Fourth embodiment: configuration in which calibration is performed during off-microphone sound amplification
(5) Fifth embodiment: configuration in which tuning is performed for each series
(6) Sixth embodiment: configuration in which evaluation information is presented
2. Modification
3. Computer configuration

1. Embodiment of Present Technology

In general, a handheld microphone, a pin microphone, or the like is used when amplifying sound (reproducing sound picked up by a microphone from a speaker installed in the same room). The reason for this is that the sensitivity of the microphone needs to be suppressed in order to reduce the amount of sneaking to the speaker or the microphone, and it is necessary to attach the microphone at a position close to the speaking person's mouth so that the sound is picked up in a large sound volume.

On the other hand, as shown in FIG. 1, sound amplification by, instead of a handheld microphone or a pin microphone, a microphone installed at a position away from the speaking person's mouth, for example, a microphone 10 attached onto a ceiling, is called off-microphone sound amplification. For example, in FIG. 1, voice spoken by a teacher is picked up by the microphone 10 attached onto a ceiling and is amplified in a classroom so that students can hear it.

However, when an off-microphone sound amplification is actually performed in a classroom, a conference room, or the like, strong howling occurs. The reason for this is that the microphone 10 attached onto the ceiling needs to have higher sensitivity than those of handheld microphones and pin microphones, and therefore the amount of sneaking of own sound from a speaker 20 to the microphone 10 is large, that is, the amount of the acoustic coupling is large.

For example, if the distance from the microphone to the speaking person's mouth increases, an input volume to the microphone decreases, so that it is necessary to increase the microphone gain. However, in a case of a pin microphone using a directional microphone, sound amplification can be performed for only about 30 cm in an actual classroom, a conference room, or the like.

On the other hand, at the time of the off-microphone sound amplification, it is necessary to increase the microphone gain to about 10 times that when using a pin microphone (for example, a pin microphone: about 30 cm, at the time of off-microphone sound amplification: about 3 m), or about 30 times that when using a handheld microphone (for example, handheld microphone: about 10 cm, at the time of off-microphone sound amplification: about 3 m), so that the amount of the acoustic coupling is greatly large, and considerable howling occurs unless measures are taken.

Here, in order to suppress howling, generally, whether or not howling occurs is measured in advance, and in a case where howling occurs, a notch filter is applied to that frequency to deal with the howling. Furthermore, in some cases, instead of the notch filter, a graphic equalizer or the like is used to reduce the gain of the frequency at which howling occurs. A device that automatically performs such processing is called a howling suppressor.

In many cases, howling can be suppressed by using this howling suppressor. However, when using a handheld microphone or a pin microphone, sound quality deterioration is within the range of practical use due to the small amount of acoustic coupling, but in the off-microphone sound amplification, due to the large amount of acoustic coupling even with a howling suppressor, the sound quality has a strong reverberation, as if a person were speaking in a bath room or a cave.

In view of such a situation, the present technology enables reduction of howling at the time of the off-microphone sound amplification and reduction of the sound quality having a strong reverberation. Furthermore, at the time of the off-microphone sound amplification, the required sound quality is different between the amplification sound signal and the recording sound signal, and there is a demand to tune each of them for optimal sound quality. The present technology enables a sound signal adapted to an intended use to be output.

Hereinafter, as the embodiments of the present technology, first to sixth embodiments will be described.

(1) First Embodiment (First Example of Configuration of Sound Processing Device)

Figure 2:
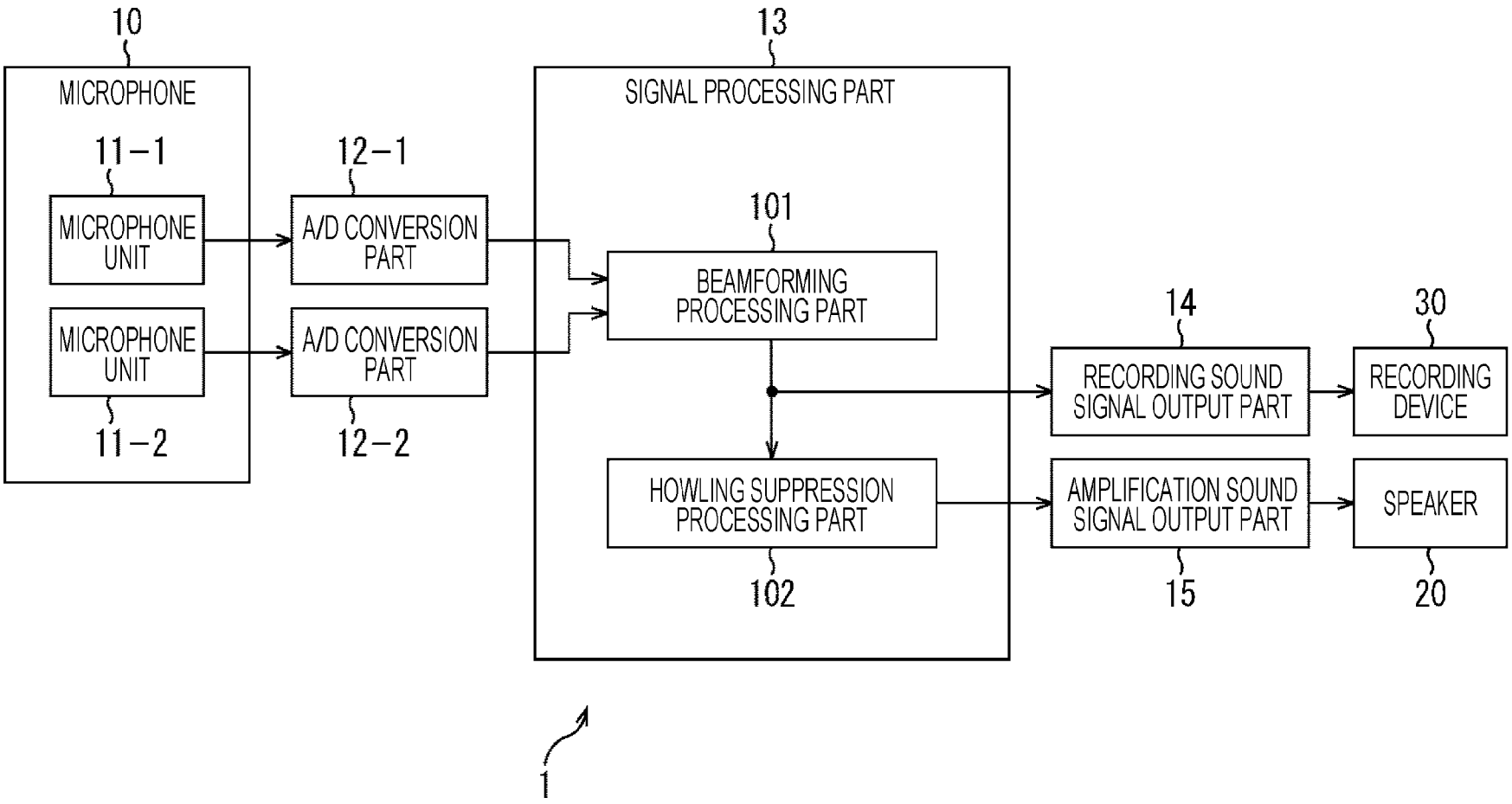
FIG. 2 is a block diagram showing a first example of a configuration of a sound processing device to which the present technology is applied.

FIG. 2 is a block diagram showing a first example of a configuration of a sound processing device to which the present technology is applied.

In FIG. 2, the sound processing device 1 includes an A/D conversion part 12, a signal processing part 13, a recording sound signal output part 14, and an amplification sound signal output part 15.

However, the sound processing device 1 may include the microphone 10 and the speaker 20. Furthermore, the microphone 10 may include all or at least a part of the A/D conversion part 12, the signal processing part 13, the recording sound signal output part 14, and the amplification sound signal output part 15.

The microphone 10 includes a microphone unit 11-1 and a microphone unit 11-2. Corresponding to the two microphone units 11-1 and 11-2, two A/D conversion parts 12-1 and 12-2 are provided in the subsequent stage.

The microphone unit 11-1 picks up sound and supplies a sound signal as an analog signal to the A/D conversion part 12-1. The A/D conversion part 12-1 converts the sound signal supplied from the microphone unit 11-1 from an analog signal into a digital signal and supplies the digital signal to the signal processing part 13.

The microphone unit 11-2 picks up sound and supplies the sound signal to the A/D conversion part 12-2. The A/D conversion part 12-2 converts the sound signal from the microphone unit 11-2 from an analog signal into a digital signal and supplies the digital signal to the signal processing part 13.

The signal processing part 13 is configured as, for example, a digital signal processor (DSP) or the like. The signal processing part 13 performs predetermined signal processing on the sound signals supplied from the A/D conversion parts 12-1 and 12-2, and outputs a sound signal obtained as a result of the signal processing.

The signal processing part 13 includes a beamforming processing part 101 and a howling suppression processing part 102.

The beamforming processing part 101 performs beamforming processing on the basis of the sound signals from the A/D conversion parts 12-1 and 12-2.

This beamforming processing can reduce sensitivity in directions other than the target sound direction while ensuring sensitivity in the target sound direction. Here, for example, a method such as an adaptive beam former is used to form directivity that reduces the sensitivity in an installation direction of the speaker 20 as directivity of (the microphone units 11-1 and 11-2 of) the microphone 10, and a monaural signal is generated. That is, here, as the directivity of the microphone 10, a directivity in which sound from the installation direction of the speaker 20 is not picked up (is not picked up as much as possible) is formed.

Note that, in order to suppress the sound from the direction of the speaker 20 (in order to prevent sound amplification) using a method such as an adaptive beamformer, it is necessary to learn internal parameters of the beamformer (hereinafter, also referred to as beam forming parameters) in the section where the sound is output only from the speaker 20. Details of this learning of beamforming parameters will be described later with reference to FIG. 3 and the like.

The beamforming processing part 101 supplies the sound signal generated by the beamforming processing to the howling suppression processing part 102. Furthermore, in a case of performing sound recording, the beamforming processing part 101 supplies the sound signal generated by the beamforming processing to the recording sound signal output part 14 as a recording sound signal.

The howling suppression processing part 102 performs howling suppression processing on the basis of the sound signal from the beamforming processing part 101. The howling suppression processing part 102 supplies the sound signal generated by the howling suppression processing to the amplification sound signal output part 15 as an amplification sound signal.

In the howling suppression processing, processing for suppressing howling is performed by using, for example, a howling suppression filter or the like. That is, in a case where the howling is not completely eliminated by the beamforming processing described above, the howling is completely suppressed by the howling suppression processing.

The recording sound signal output part 14 includes a recording sound output terminal. The recording sound signal output part 14 outputs the recording sound signal supplied from the signal processing part 13 to a recording device 30 connected to the recording sound output terminal.

The recording device 30 is a device having a recording part (for example, a semiconductor memory, a hard disk, an optical disk, or the like) of a recorder, a personal computer, or the like, for example. The recording device 30 records the recording sound signal output from (the recording sound signal output part 14 of) the sound processing device 1 as recording data having a predetermined format. The recording sound signal is a high-quality sound signal that does not pass through the howling suppression processing part 102.

The amplification sound signal output part 15 includes an amplification sound output terminal. The amplification sound signal output part 15 outputs the amplification sound signal supplied from the signal processing part 13 to the speaker 20 connected to the amplification sound output terminal.

The speaker 20 processes the amplification sound signal output from (the amplification sound signal output part 15 of) the sound processing device 1, and outputs the sound corresponding to the amplification sound signal. By passing through the howling suppression processing part 102, this amplification sound signal becomes a sound signal in which howling is completely suppressed.

In the sound processing device 1 configured as described above, the beamforming processing is performed but the howling suppression processing is not performed on the recording sound signal so that a high-quality sound signal can be obtained. On the other hand, the howling suppression processing is performed together with the beamforming processing on the amplification sound signal so that the sound signal in which howling is suppressed can be obtained. Therefore, by performing different processing for the recording sound signal and the amplification sound signal, it is possible to tune each of them for the optimal sound quality, so that a sound signal adapted to an intended use such as for recording, for amplification, or the like can be output.

That is, in the sound processing device 1, if attention is paid to the amplification sound signal, by performing beamforming processing and howling suppression processing to reduce howling at the time of off-microphone sound amplification, and to reduce the reverberant sound quality, so that it is possible to output a sound signal more suitable for amplification. On the other hand, if attention is paid to the recording sound signal, it is not necessary to perform the howling suppression processing that causes deterioration in sound quality. Therefore, in the sound processing device 1, as the recording sound signal output to the recording device 30, a high-quality sound signal that does not pass through the howling suppression processing part 102 is output, so that a sound signal that is more suitable for recording can be recorded.

Note that, in the configuration shown in FIG. 2, a case where two microphone units 11-1 and 11-2 are provided has been shown, but three or more microphone units can be provided. For example, in a case of performing the above-mentioned beamforming processing, it is advantageous to provide more microphone units. Moreover, in the configuration shown in FIGS. 1 and 2, the configuration in which one speaker 20 is installed is illustrated, but the number of speakers 20 is not limited to one, and a plurality of speakers 20 can be installed.

Furthermore, in the configuration shown in FIG. 2, a configuration in which the A/D conversion parts 12-1 and 12-2 are provided in the subsequent stage of the microphone units 11-1 and 11-2 has been shown, but an amplifier may be provided in each preceding stage of the A/D conversion parts 12-1 and 12-2 so that the amplified sound signals (analog signals) are input.

(2) Second Embodiment (Second Example of Configuration of Sound Processing Device)

Figure 3:
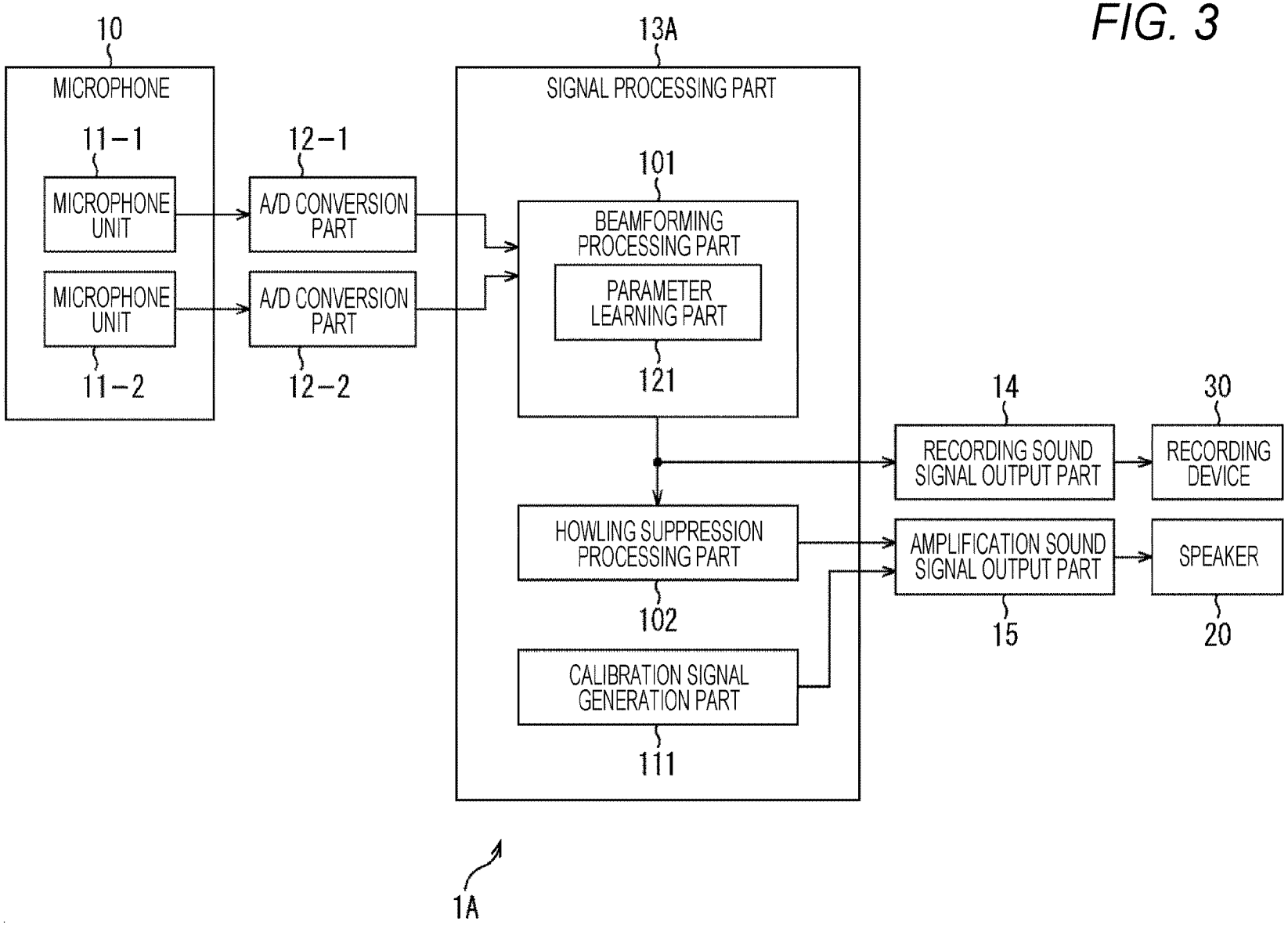
FIG. 3 is a block diagram showing a second example of a configuration of a sound processing device to which the present technology is applied.

FIG. 3 is a block diagram showing a second example of a configuration of a sound processing device to which the present technology is applied.

In FIG. 3, a sound processing device 1A differs from the sound processing device 1 shown in FIG. 2 in that a signal processing part 13A is provided instead of the signal processing part 13.

The signal processing part 13A includes a beamforming processing part 101, a howling suppression processing part 102, and a calibration signal generation part 111.

The beamforming processing part 101 includes a parameter learning part 121. The parameter learning part 121 learns the beamforming parameters used in the beamforming processing on the basis of the sound signal picked up by the microphone 10.

That is, in the beamforming processing part 101, in order to suppress the sound from the direction of the speaker 20 (to prevent sound amplification) by using a method such as an adaptive beamformer, in a section where the sound is output only from the speaker 20, the beamforming parameters are leant, and the directivity for reducing the sensitivity in the installation direction of the speaker 20 is calculated as the directivity of the microphone 10.

Note that, as the directivity of the microphone 10, reducing the sensitivity in the installation direction of the speaker 20 is, in other words, creating a blind spot (so-called NULL directivity) in the installation direction of the speaker 20, and thereby, not picking up (not picking up as much as possible) the sound from the installation direction of the speaker 20 is possible.

Here, in a scene where sound amplification according to the amplification sound signal is performed by the speaker 20, the sound of a speaking person and the sound from the speaker 20 are simultaneously input to the microphone 10A, and this is not suitable as a learning section. Therefore, a calibration period for adjusting the beamforming parameters is provided in advance (for example, at the time of setting), and during this calibration period, the calibration sound is output from the speaker 20 to prepare a section where sound is output only from the speaker 20, and the beamforming parameters are learned.

The calibration sound output from the speaker 20 is output when the calibration signal generated by the calibration signal generation part 111 is supplied to the speaker 20 via the amplification sound signal output part 15. The calibration signal generation part 111 generates a calibration signal such as a white noise signal or a time stretched pulse (TSP) signal, and outputs the signals as calibration sound from the speaker 20, for example.

Note that, in the above-described description, in the beamforming processing, the adaptive beamformer has been described as an example of the method of suppressing sound from the installation direction of the speaker 20, but, for example, other methods such as the delay sum method and the three-microphone integration method are also known, and the beamforming method to be used is arbitrary.

Figure 4:
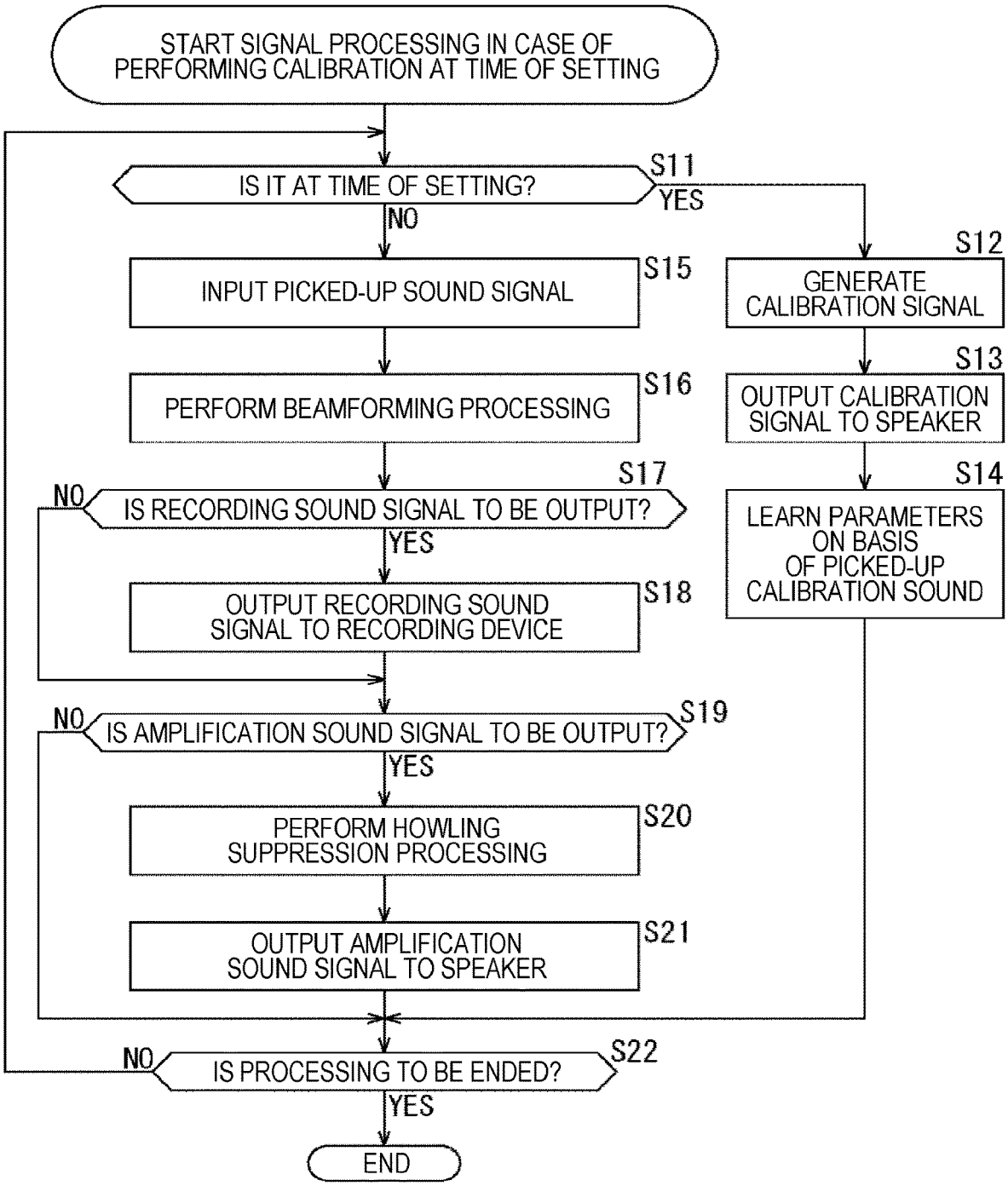
FIG. 4 is a flowchart for explaining the flow of signal processing in a case where calibration is performed at the time of setting.

In the sound processing device 1A configured as described above, signal processing in a case where calibration is performed at the time of setting as shown in the flowchart of FIG. 4 is performed.

In step S11, it is determined whether or not it is at the time of setting. In a case where it is determined in step S11 that it is at the time of setting, the process proceeds to step S12, and the processing of steps S12 to S14 is performed to perform calibration at the time of setting.

In step S12, the calibration signal generation part 111 generates a calibration signal. For example, a white noise signal, a TSP signal, or the like is generated as the calibration signal.

In step S13, the amplification sound signal output part 15 outputs the calibration signal generated by the calibration signal generation part 111 to the speaker 20.

Therefore, the speaker 20 outputs a calibration sound (for example, white noise or the like) according to the calibration signal from the sound processing device 1A. On the other hand, (the microphone units 11-1 and 11-2 of) the microphone 10 picks up the calibration sound (for example, white noise or the like), so that, in the sound processing device 1A, after the processing such as A/D conversion is performed on the sound signal, the signal is input to the signal processing part 13A.

In step S14, the parameter learning part 121 learns beamforming parameters on the basis of the picked calibration sound. As learning here, in order to suppress the sound from the direction of the speaker 20 by using a method such as an adaptive beam former, in a section where a calibration sound (for example, white noise or the like) is output only from the speaker 20, beamforming parameters are learned.

When the processing of step S14 ends, the process proceeds to step S22. In step S22, it is determined whether or not to end the signal processing. In a case where it is determined in step S22 that the signal processing is continued, the process returns to step S11, and processing in step S11 and subsequent steps is repeated.

On the other hand, in a case where it is determined in step S11 that it is not at the time of setting, the process proceeds to step S15, and the processing of steps S15 to S21 is performed to perform the processing in the off-microphone sound amplification.

In step S15, the beamforming processing part 101 inputs the sound signal picked up by (the microphone units 11-1 and 11-2 of) the microphone 10. The sound signal includes, for example, sound uttered by a speaking person.

In step S16, the beamforming processing part 101 performs the beamforming processing on the basis of the sound signal picked up by the microphone 10.

In this beamforming processing, at the time of setting, a method such as an adaptive beamformer that applies the beamforming parameters learned by performing the processing of steps S12 to S14 is used, and as the directivity of the microphone 10, the directivity in which sensitivity in the installation direction of the speaker 20 is reduced (sound from the installation direction of the speaker 20 is not picked up (is not picked up as much as possible)) is formed.

Figure 5:
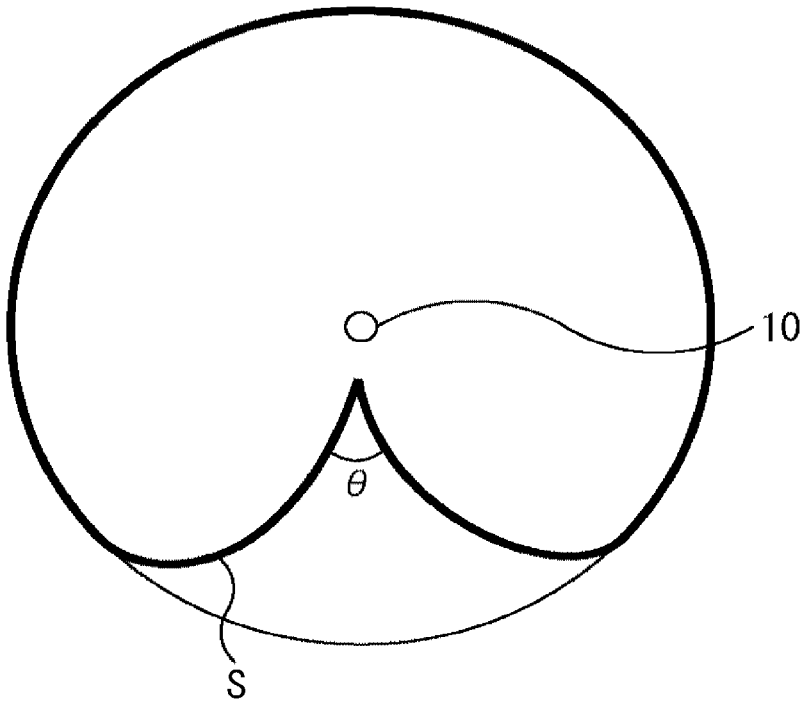
FIG. 5 is a diagram showing an example of directivity of the microphone.

Here, FIG. 5 shows the directivity of the microphone 10 by a polar pattern. In FIG. 5, the sensitivity of 360 degrees around the microphone 10 is represented by a thick line S in the drawing, but the directivity of the microphone 10 is the directivity in which the speaker 20 is installed, and is such that a blind spot (NULL directivity) is formed in the rear direction of the angle θ in the drawing.

That is, in the beamforming processing, by directing the blind spot in the installation direction of the speaker 20, the directivity in which the sensitivity in the installation direction of the speaker 20 is reduced (the sound from the installation direction of the speaker 20 is not picked up (is not picked up as much as possible) can be formed.

In step S17, it is determined whether or not to output the recording sound signal. In a case where it is determined in step S17 that the recording sound signal is to be output, the processing proceeds to step S18.

In step S18, the recording sound signal output part 14 outputs the recording sound signal obtained by the beamforming processing to the recording device 30. Therefore, the recording device 30 can record, as recording data, a high-quality recording sound signal that does not pass through the howling suppression processing part 102.

When the processing of step S18 ends, the process proceeds to step S19. Note that, in a case where it is determined in step S17 that the recording sound signal is not output, the process of step S18 is skipped and the process proceeds to step S19.

In step S19, it is determined whether or not to output the amplification sound signal. In a case where it is determined in step S19 that the amplification sound signal is to be output, the processing proceeds to step S20.

In step S20, the howling suppression processing part 102 performs the howling suppression processing on the basis of the sound signal obtained by the beamforming processing. In the howling suppression processing, processing for suppressing howling is performed by using, for example, a howling suppression filter or the like.

In step S21, the amplification sound signal output part 15 outputs the amplification sound signal obtained by the howling suppression processing to the speaker 20. Therefore, the speaker 20 can output a sound corresponding to the amplification sound signal in which howling is completely suppressed through the howling suppression processing part 102.

When the processing of step S21 ends, the process proceeds to step S22. Note that, in a case where it is determined in step S19 that the amplification sound signal is not output, the process of steps S20 to S21 is skipped and the process proceeds to step S22.

In step S22, it is determined whether or not to end the signal processing. In a case where it is determined in step S22 that the signal processing is continued, the process returns to step S11, and processing in step S11 and subsequent steps is repeated. On the other hand, in a case where it is determined in step S22 that the signal processing is to be ended, the signal processing shown in FIG. 4 is ended.

The flow of signal processing in the case of performing calibration at the time of setting has been described above. In this signal processing, beamforming parameters are learned by performing calibration at the time of setting, and at the time of off-microphone sound amplification, beamforming processing is performed by using a method such as an adaptive beamformer that applies the learned beamforming parameters. Therefore, it is possible to perform beamforming processing using a more suitable beamforming parameter as a beamforming parameter for making the installation direction of the speaker 20 a blind spot.

(3) Third Embodiment

In the above-described second embodiment, the case where the calibration is performed using white noise or the like at the time of setting has been described. However, only by performing the calibration at the time of setting, it is assumed that the amount of sound suppression from the installation direction of the speaker 20 becomes worse than that when the speaker 20 is installed, due to a change in an acoustic system by, for example, deterioration of the microphone 10 over time, opening and closing of a door installed at an entrance of a room, or the like. As a result, there is a possibility that howling occurs and the amplification quality deteriorates at the time of the off-microphone sound amplification.

Therefore, in a third embodiment, a configuration will be described in which, for example, at the start of use such as the start of a lesson or the beginning of a conference (a period before the start of amplification), a sound effect is output from the speaker 20, the sound effect is picked up by the microphone 10, learning (re-learning) of beamforming parameters in the section is performed, and calibration in the installation direction of the speaker 20 is performed.

Note that, in the third embodiment, the configuration of the sound processing device 1 is similar to the configuration of the sound processing device 1A shown in FIG. 3, and therefore the description of the configuration is omitted here.

Figure 6:
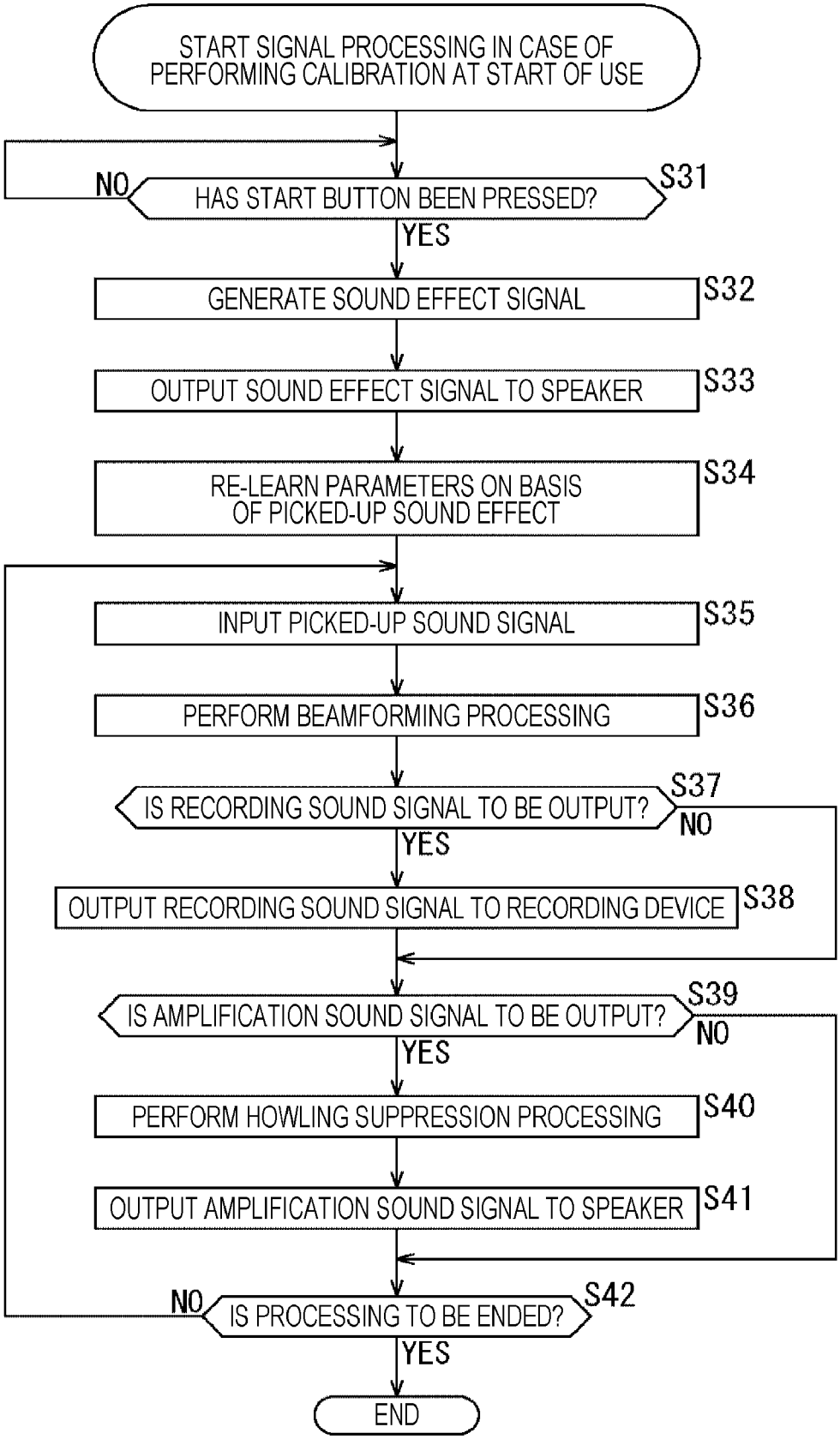
FIG. 6 is a flowchart for explaining the flow of signal processing in a case where calibration is performed at the start of use.

FIG. 6 is a flowchart for explaining the flow of signal processing when calibration is performed at the start of use, the processing performed by the sound processing device 1A (FIG. 3) of the third embodiment.

In step S31, it is determined whether or not a start button such as an amplification start button or a recording start button has been pressed. In a case where it is determined in step S31 that the start button has not been pressed, the determination processing of step S31 is repeated, and the process waits until the start button is pressed.

In a case where it is determined in step S31 that the start button has been pressed, the process proceeds to step S32, and the processing of steps S32 to S34 is performed to perform calibration at the start of use.

In step S32, the calibration signal generation part 111 generates a sound effect signal.

In step S33, the amplification sound signal output part 15 outputs the sound effect signal generated by the calibration signal generation part 111 to the speaker 20.

Therefore, the speaker 20 outputs a sound effect corresponding to the sound effect signal from the sound processing device 1A. On the other hand, the microphone 10 picks up the sound effect, so that, in the sound processing device 1A, after the processing such as A/D conversion is performed on the sound signal, the signal is input to the signal processing part 13A.

In step S34, the parameter learning part 121 learns (relearns) beamforming parameters on the basis of the picked-up sound effect. As learning here, in order to suppress the sound from the direction of the speaker 20 by using a method such as an adaptive beam former, in a section where a sound effect is output only from the speaker 20, beamforming parameters are learned.

When the processing of step S34 ends, the process proceeds to step S35. In steps S35 to S41, the processing at the time of off-microphone sound amplification is performed as similar to above-described steps S15 to S21 in FIG. 4. At this time, in the processing of step S36, the beamforming processing is performed, but here, at the start of use, a method such as an adaptive beamformer that applies the beamforming parameters relearned by performing the processing of steps S32 to S34 is used to form the directivity of the microphone 10.

The flow of signal processing in the case of performing calibration at the start of use has been described above. In this signal processing, for example, a sound effect is output from the speaker 20 before the start of sound amplification such as the beginning of a lesson or the beginning of a conference, and the sound effect is picked up by the microphone 10 and then relearning of the beamforming parameters is performed in that section. By using such re-learned beamforming parameters, it is possible to prevent the amount of sound suppression from the installation direction of the speaker 20 from becoming worse than that when the speaker 20 is installed, due to a change in an acoustic system by, for example, deterioration of the microphone 10 over time, opening and closing of a door installed at an entrance of a room, or the like, and as a result, it is possible to more reliably suppress the occurrence of howling and the deterioration of the sound amplification quality at the time of the off-microphone sound amplification.

Note that, in the third embodiment, the sound effect has been described as the sound output from the speaker 20 in the period before the start of the sound amplification, but the sound is not limited to the sound effect, and the calibration at the start of use can be performed with other sound. Other sound may be used as long as it is a sound (predetermined sound) corresponding to the signal for sound generated by the calibration signal generation part 111.

(4) Fourth Embodiment

In the above-described third embodiment, the case where the sound effect is output and the calibration is performed at the start of the lesson or the conference has been described, for example, but in a fourth embodiment, a configuration will be described in which noise is added to a masking band of a sound signal, so that the calibration can be performed during the off-microphone sound amplification.

(Third Example of Configuration of Sound Processing Device)

Figure 7:
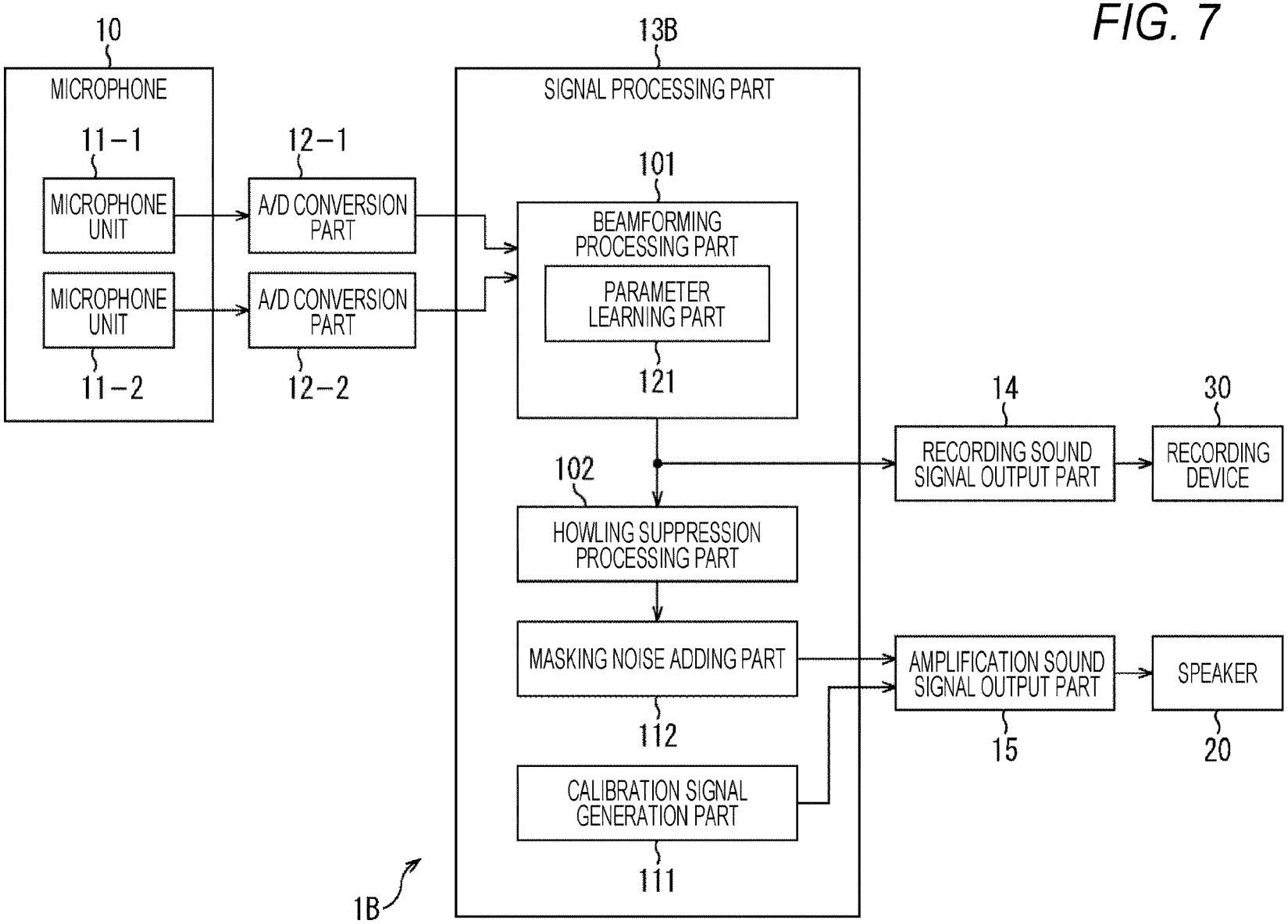
FIG. 7 is a block diagram showing a third example of a configuration of a sound processing device to which the present technology is applied.

FIG. 7 is a block diagram showing a third example of a configuration of a sound processing device to which the present technology is applied.

In FIG. 7, a sound processing device 1B differs from the sound processing device 1A shown in FIG. 3 in that a signal processing part 13B is provided instead of the signal processing part 13A. The signal processing part 13B has a masking noise adding part 112 newly provided in addition to the beamforming processing part 101, the howling suppression processing part 102, and the calibration signal generation part 111.

The masking noise adding part 112 adds noise to the masking band of the amplification sound signal supplied from the howling suppression processing part 102, and supplies the amplification sound signal to which the noise has been added to the amplification sound signal output part 15. Therefore, the speaker 20 outputs a sound corresponding to the amplification sound signal to which noise has been added.

The parameter learning part 121 learns (or relearns) beamforming parameters on the basis of the noise included in the sound picked up by the microphone 10. Therefore, the beamforming processing part 101 performs the beamforming processing using a method such as an adaptive beamformer that applies the beamforming parameters learned during the off-microphone sound amplification (so to speak, learned behind the sound amplification).

Figure 8:
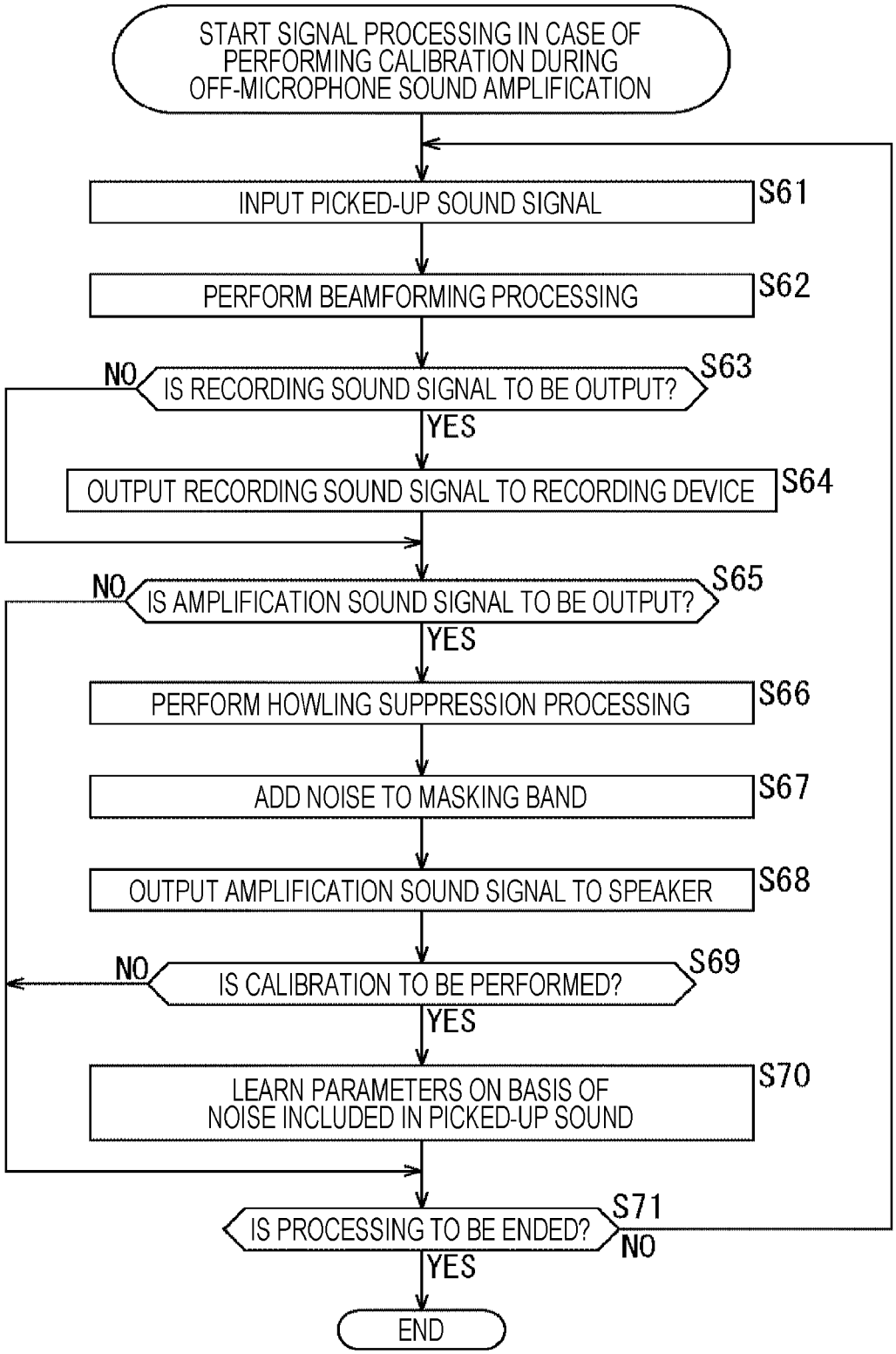
FIG. 8 is a flowchart for explaining the flow of signal processing in a case where calibration is performed during sound amplification.

In the sound processing device 1B configured as described above, signal processing in a case where calibration is performed during the off-microphone sound amplification as shown in the flowchart of FIG. 8 is performed.

In steps S61 and S62, as similar to above-described steps S15 and S16 in FIG. 4, the beamforming processing part 101 performs beamforming processing on the basis of the sound signals picked up by the microphone units 11-1 and 11-2.

In steps S63 and S64, as similar to above-described steps S17 and S18 in FIG. 4, in a case where it is determined that the recording sound signal is to be output, the recording sound signal output part 14 outputs the recording sound signal obtained by the beamforming processing to the recording device 30.

In step S65, it is determined whether or not to output the amplification sound signal. In a case where it is determined in step S65 that the amplification sound signal is to be output, the processing proceeds to step S66.

In step S66, the howling suppression processing part 102 performs the howling suppression processing on the basis of the sound signal obtained by the beamforming processing.

In step S67, the masking noise adding part 112 adds noise to the masking band of the sound signal (amplification sound signal) obtained by the howling suppression processing.

Here, for example, in a case where certain input sound (sound signal) input to the microphone 10 is sound that is biased to the low band, since there is no input sound (sound signal) in the high band, the sound obtained by adding noise thereto can be used for high-band calibration.

However, if the volume of noise added to this high frequency range is large, there is a fear that the noise is noticeable. Therefore, the amount of noise added here is limited to the masking level. Note that, in this example, for simplification of the description, the patterns of the low band and the high band are simply shown, but this can be applied to all the usual masking bands.

In step S68, the amplification sound signal output part 15 outputs the amplification sound signal to which the noise has been added to the speaker 20. Therefore, the speaker 20 outputs a sound corresponding to the amplification sound signal to which noise has been added.

In step S69, it is determined whether or not to perform calibration during off-microphone sound amplification. In a case where it is determined in step S69 that the calibration is performed during the off-microphone sound amplification, the process proceeds to step S70.

In step S70, the parameter learning part 121 learns (or relearns) the beamforming parameters on the basis of the noise included in the picked-up sound. As learning here, in order to suppress the sound from the direction of the speaker 20 by using a method such as an adaptive beam former, beamforming parameters are learned (adjusted) on the basis of the noise added to the sound output from the speaker 20.

When the processing of step S70 ends, the process proceeds to step S71. Furthermore, in a case where it is determined in step S65 that the amplification sound signal is not to be output, or also in a case where it is determined in step S69 that the calibration during off-microphone sound amplification is not to be performed, the process proceeds to step S71.

In step S71, it is determined whether or not to end the signal processing. In a case where it is determined in step S71 that the signal processing is continued, the process returns to step S61, and processing in step S61 and subsequent steps is repeated. At this time, in the processing of step S62, the beamforming processing is performed, but here, a method such as an adaptive beamformer that applies the beamforming parameters learned during the off-microphone sound amplification by processing of step S70 is used to form the directivity of the microphone 10.

Note that, in a case where it is determined in step S71 that the signal processing is to be ended, the signal processing shown in FIG. 8 is ended.

The flow of signal processing in the case of performing calibration during the off-microphone sound amplification has been described above. In this signal processing, noise is added to the masking band of the amplification sound signal, and calibration is performed during the off-microphone sound amplification, and therefore, calibration can be performed without outputting the sound effect like in the third embodiment.

(5) Fifth Embodiment

In the above-described embodiments, as the signal processing performed by the signal processing part 13, only the beamforming processing and the howling suppression processing are described, but the signal processing for the picked-up sound signal is not limited to this, and other signal processing may be performed.

When performing such other signal processing, it is possible to perform tuning adapted to each series when parameters used in the other signal processing are divided into a recording (recording sound signal) series and amplification (amplification sound signal) series. For example, in the recording series, parameters can be set such that the sound quality is emphasized and the volumes are equalized, while in the amplification series, parameters can be set such that the noise suppression quantity is emphasized and the sound volume is not adjusted strongly.

Therefore, in a fifth embodiment, a configuration will be described in which an appropriate parameter is set for each series in the recording series and the amplification series, so that a tuning adapted to each series can be performed.

(Fourth Example of Configuration of Sound Processing Device)

Figure 9:
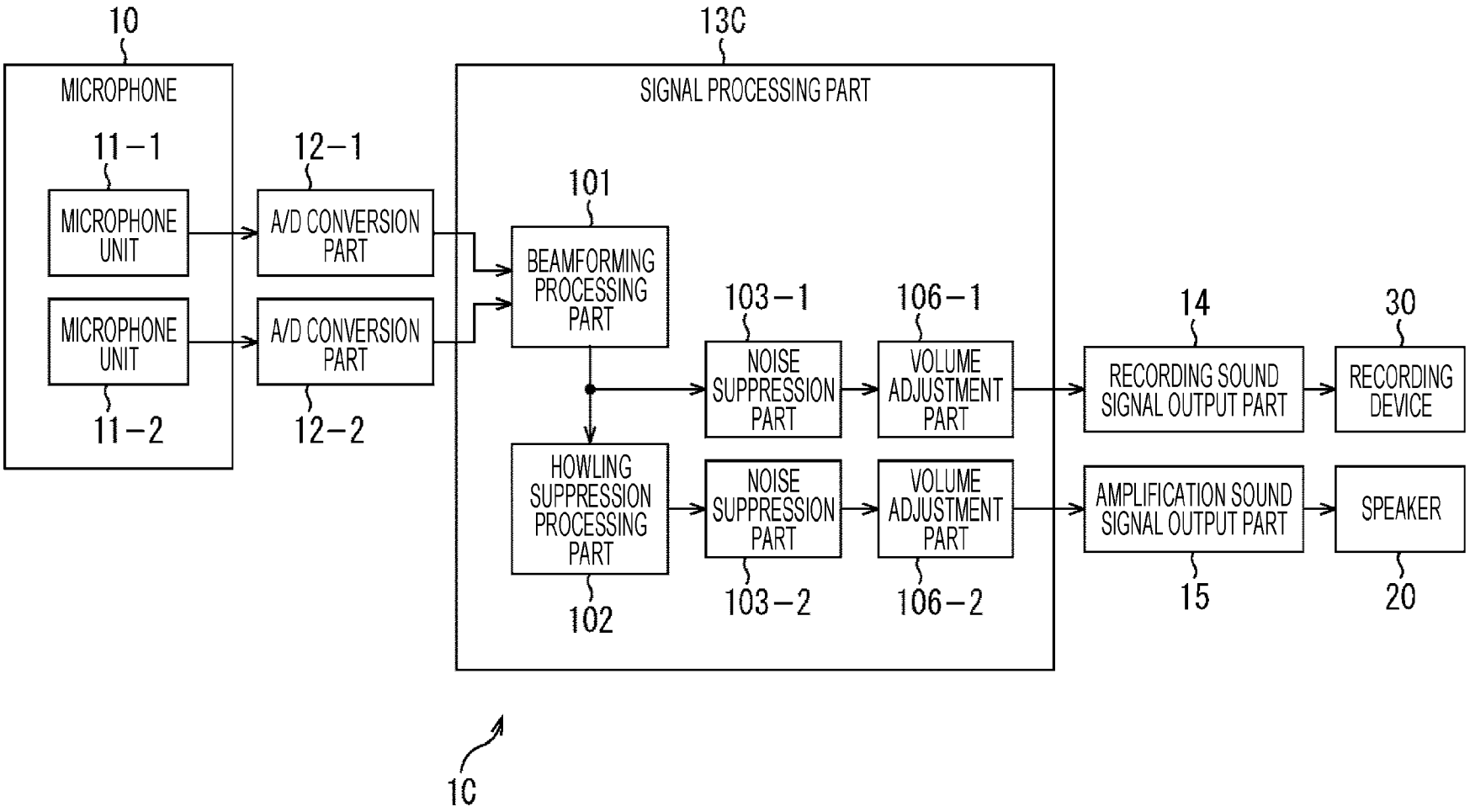
FIG. 9 is a block diagram showing a fourth example of a configuration of a sound processing device to which the present technology is applied.

FIG. 9 is a block diagram showing a fourth example of a configuration of a sound processing device to which the present technology is applied.

In FIG. 9, a sound processing device 1C differs from the sound processing device 1 shown in FIG. 2 in that a signal processing part 13C is provided instead of the signal processing part 13.

The signal processing part 13C includes the beamforming processing part 101, the howling suppression processing part 102, noise suppression parts 103-1 and 103-2, and volume adjustment parts 106-1 and 106-2.

The beamforming processing part 101 performs beamforming processing and supplies the sound signal obtained by the beamforming processing to the howling suppression processing part 102. Furthermore, in a case where sound recording is performed, the beamforming processing part 101 supplies the sound signal obtained by the beamforming processing to the noise suppression part 103-1 as a recording sound signal.

The noise suppression part 103-1 performs noise suppression processing on the recording sound signal supplied from the beamforming processing part 101, and supplies the resulting recording sound signal to the volume adjustment part 106-1. For example, the noise suppression part 103-1 is tuned with emphasis on sound quality, and when performing noise suppression processing, the noise is suppressed while emphasizing the sound quality of the recording sound signal.

The volume adjustment part 106-1 performs volume adjusting processing (for example, auto gain control (AGC) processing) on the recording sound signal supplied from the noise suppression part 103-1 and supplies the resulting recording sound signal to the recording sound signal output part 14. For example, the volume adjustment part 106-1 is tuned so that the volumes are equalized, and when performing the volume adjusting processing, in order to make it easy to hear from small sound to large sound, the volume of the recording sound signal is adjusted so that the small sound and the large sound are equalized.

The recording sound signal output part 14 outputs the recording sound signal supplied from (the volume adjustment part 106-1 of) the signal processing part 13C to a recording device 30. Therefore, the recording device 30 can record, for example, as a sound signal suitable for recording, a recording sound signal that has been adjusted such that the sound quality is preferable, and sound is easy to hear from small sound to large sound.

The howling suppression processing part 102 performs howling suppression processing on the basis of the sound signal from the beamforming processing part 101. The howling suppression processing part 102 supplies the sound signal obtained by the howling suppression processing to the noise suppression part 103-2 as a sound signal for sound amplification.

The noise suppression part 103-2 performs noise suppression processing on the amplification sound signal supplied from the howling suppression processing part 102, and supplies the resulting amplification sound signal to the volume adjustment part 106-2. For example, the noise suppression part 103-2 is tuned with emphasis on noise suppression amount, and when performing noise suppression processing, the noise in the amplification sound signal is suppressed while emphasizing the noise suppression amount more than the sound quality.

The volume adjustment part 106-2 performs volume adjusting processing (for example, AGC processing) on the amplification sound signal supplied from the noise suppression part 103-2 and supplies the resulting amplification sound signal to the amplification sound signal output part 15. For example, the volume adjustment part 106-2 is tuned so that the volume is not adjusted strongly, and when performing the volume adjusting processing, the volume of the amplification sound signal is adjusted such that the sound quality at the time of the off-microphone sound amplification is hard to be degraded or the howling is hard to occur.

The amplification sound signal output part 15 outputs the amplification sound signal supplied from (the volume adjustment part 106-2 of) the signal processing part 13C to the speaker 20. Therefore, in the speaker 20, for example, as sound suitable for off-microphone sound amplification, sound can be output on the basis of an amplification sound signal that has been adjusted to be sound in which noise is further suppressed, and sound quality is not deteriorated at the time of off-microphone sound amplification, and howling is difficult to occur.

In the sound processing device 1C configured as described above, an appropriate parameter is set for each series of the recording series including the beamforming processing part 101, the noise suppression part 103-1 and the volume adjustment part 106-1, and the amplification series including the beamforming processing part 101, the howling suppression processing part 102, the noise suppression part 103-2, and the volume adjustment part 106-2, and tuning adapted to each series is performed. Therefore, at the time of recording, a recording sound signal more suitable for recording can be recorded in the recording device 30, while at the time of off-microphone sound amplification, an amplification sound signal more suitable for sound amplification can be output to the speaker 20.

(Fifth Example of Configuration of Sound Processing Device)

Figure 10:
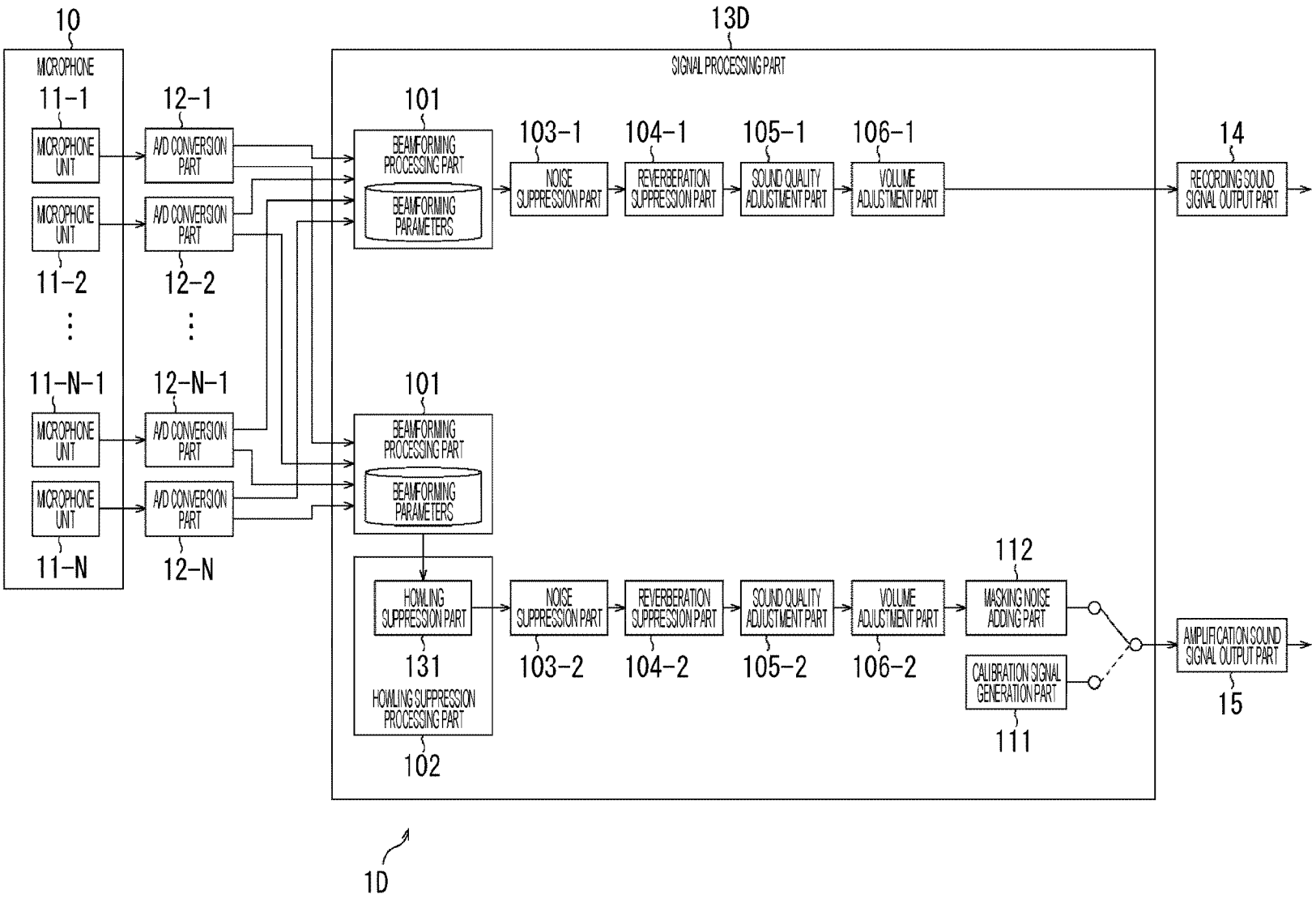
FIG. 10 is a block diagram showing a fifth example of a configuration of a sound processing device to which the present technology is applied.

FIG. 10 is a block diagram showing a fifth example of a configuration of a sound processing device to which the present technology is applied.

In FIG. 10, a sound processing device 1D differs from the sound processing device 1 shown in FIG. 2 in that a signal processing part 13D is provided instead of the signal processing part 13. Furthermore, in FIG. 10, the microphone 10 includes microphone units 11-1 to 11-N (N: an integer of one or more), and N A/D conversion parts 12-1 to 12-N are provided corresponding to the N microphone units 11-1 to 11-N.

The signal processing part 13D includes the beamforming processing part 101, the howling suppression processing part 102, the noise suppression parts 103-1 and 103-2, reverberation suppression parts 104-1 and 104-2, sound quality adjustment parts 105-1 and 105-2, a volume adjustment parts 106-1 and 106-2, a calibration signal generation part 111, and a masking noise adding part 112.

That is, as compared to the signal processing part 13C of the sound processing device 1C shown in FIG. 9, the signal processing part 13D is provided with the reverberation suppression part 104-1 and the sound quality adjustment part 105-1, in addition to the beamforming processing part 101, the noise suppression part 103-1, and the volume adjustment part 106-1 as a recording series. Furthermore, the signal processing part 13D is provided with the reverberation suppression part 104-2 and the sound quality adjustment part 105-2 in addition to the beamforming processing part 101, the howling suppression processing part 102, the noise suppression part 103-2, and the volume adjustment part 106-2.

In the recording series, the reverberation suppression part 104-1 performs reverberation suppression processing on the recording sound signal supplied from the noise suppression part 103-1, and supplies the resulting recording sound signal to the sound quality adjustment part 105-1. For example, the reverberation suppression part 104-1 is tuned to be suitable for recording, and when the reverberation suppression processing is performed, the reverberation included in the recording sound signal is suppressed on the basis of the recording parameters.

The sound quality adjustment part 105-1 performs sound quality adjustment processing (for example, equalizer processing) on the recording sound signal supplied from the reverberation suppression part 104-1, and supplies the resulting recording sound signal to the volume adjustment part 106-1. For example, the sound quality adjustment part 105-1 is tuned to be suitable for recording, and when the sound quality adjustment processing is performed, the sound quality of the recording sound signal is adjusted on the basis of the recording parameters.

On the other hand, in the amplification series, the reverberation suppression part 104-2 performs reverberation suppression processing on the amplification sound signal supplied from the noise suppression part 103-2, and supplies the resulting amplification sound signal to the sound quality adjustment part 105-2. For example, the reverberation suppression part 104-2 is tuned to be suitable for amplification, and when the reverberation suppression processing is performed, the reverberation included in the amplification sound signal is suppressed on the basis of the amplification parameters.

The sound quality adjustment part 105-2 performs sound quality adjustment processing (for example, equalizer processing) on the amplification sound signal supplied from the reverberation suppression part 104-2, and supplies the resulting amplification sound signal to the volume adjustment part 106-2. For example, the sound quality adjustment part 105-2 is tuned to be suitable for amplification, and when the sound quality adjustment processing is performed, the sound quality of the amplification sound signal is adjusted on the basis of the amplification parameters.

In the sound processing device 1D configured as described above, an appropriate parameter (for example, parameter for recording and parameter for amplification) is set for each series of the recording series including the beamforming processing part 101, and the noise suppression part 103-1 or the volume adjustment part 106-1, and the amplification series including the beamforming processing part 101, the howling suppression processing part 102, and the noise suppression part 103-2, or the volume adjustment part 106-2, and tuning adapted to each processing part of each series is performed.

Note that, in FIG. 10, the howling suppression processing part 102 includes a howling suppression part 131. The howling suppression part 131 includes a howling suppression filter and the like, and performs processing for suppressing howling. Furthermore, although FIG. 10 shows a configuration in which the beamforming processing part 101 is provided for each of the recording sequence and the amplification sequence, the beamforming processing part 101 of each sequence may be integrated into one.

Furthermore, the calibration signal generation part 111 and the masking noise adding part 112 have been described by the signal processing part 13A shown in FIG. 3 and the signal processing part 13B shown in FIG. 7, and therefore description thereof will be omitted here. However, at the time of calibration, the calibration signal from the calibration signal generation part 111 is output, while at the time of the off-microphone sound amplification, the masking noise adding part 112 can output an amplification sound signal to which the noise from the masking noise adding part 112 has been added.

(Sixth Example of Configuration of Sound Processing Device)

Figure 11:
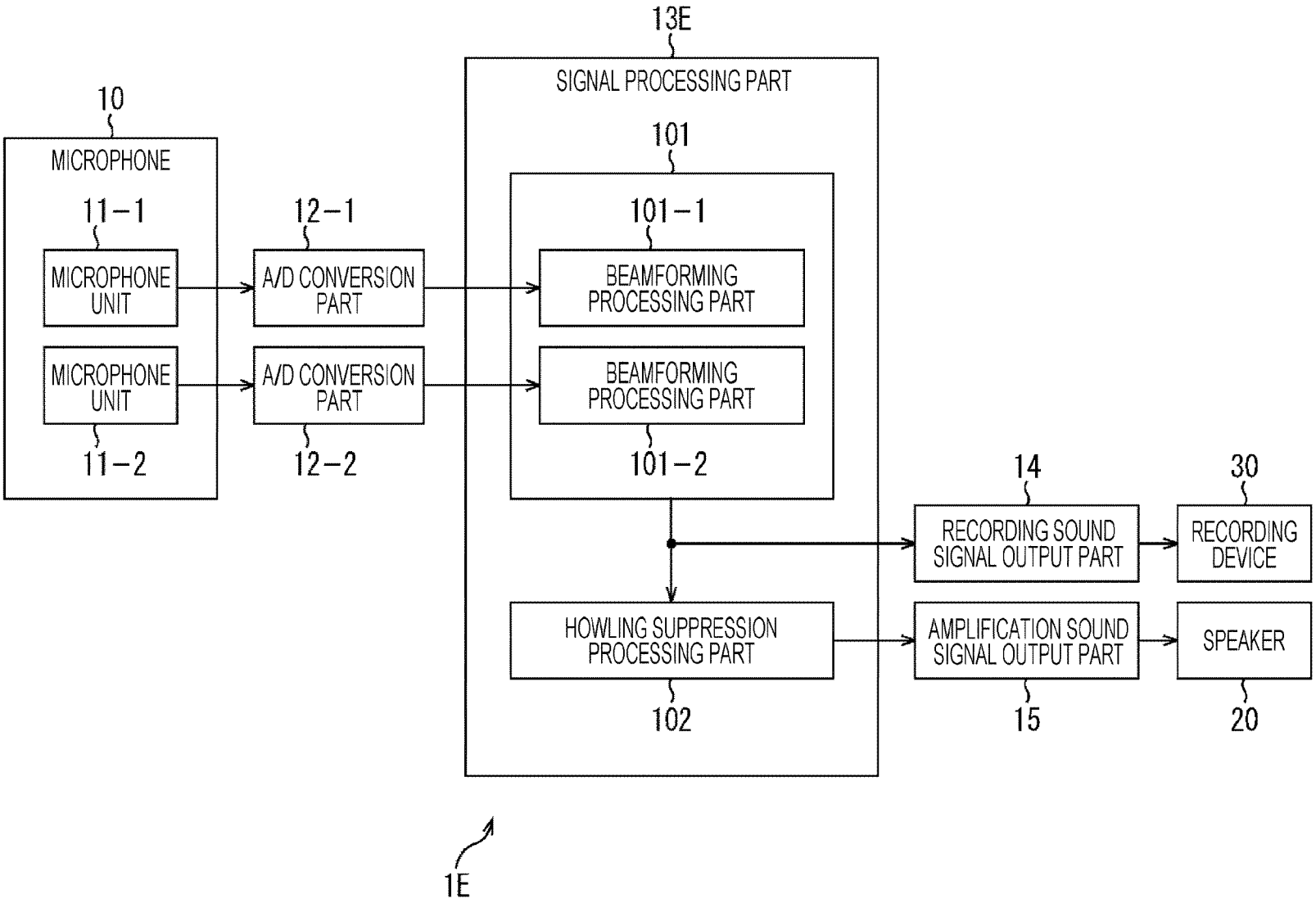
FIG. 11 is a block diagram showing a sixth example of a configuration of a sound processing device to which the present technology is applied.

FIG. 11 is a block diagram showing a sixth example of a configuration of a sound processing device to which the present technology is applied.

In FIG. 11, a sound processing device 1E differs from the sound processing device 1 shown in FIG. 2 in that a signal processing part 13E is provided instead of the signal processing part 13.

The signal processing part 13E includes a beamforming processing part 101-1 and a beamforming processing part 101-2 as the beamforming processing part 101.

The beamforming processing part 101-1 performs beamforming processing on the basis of the sound signals from the A/D conversion part 12-1. The beamforming processing part 101-2 performs beamforming processing on the basis of the sound signals from the A/D conversion part 12-2.

As described above, in the signal processing part 13E, the two beamforming processing parts 101-1 and 101-2 are provided corresponding to the two microphone units 11-1 and 11-2. In the beamforming processing parts 101-1 and 101-2, the beamforming parameters are learned, and the beamforming processing using the learned beamforming parameters is performed.

Note that, in the signal processing part 13E of FIG. 11, the case where two beamforming processing parts 101 (101-1, 101-2) are provided in accordance with the two microphone units 11 (11-1, 11-2) and the A/D conversion parts 12 (12-1, 12-2) has been described. However, in a case where a larger number of microphone units 11 are provided, the beamforming processing part 101 can be added accordingly.

(6) Sixth Embodiment

By the way, it is possible to reduce the sneaking of sound from the speaker 20 by the beamforming processing, but the amount of suppression is limited. Therefore, if the sound amplification sound volume is increased at the time of the off-microphone sound amplification, the sound quality is very reverberant, as if a person were speaking in a bath room or the like. That is, at the time of the off-microphone sound amplification, the sound amplification sound volume and the sound quality have a trade-off relationship.

In a sixth embodiment, a configuration will be described in which, in order to enable a user such as an installer of the microphone 10 or the speaker 20 to determine whether or not the sound amplification sound volume is appropriate, for example, in consideration of such a relationship between the sound volume and the sound quality, information (hereinafter, referred to as evaluation information) including an evaluation regarding sound quality at the time of the off-microphone sound amplification is generated and presented.

(Configuration Example of Information Processing Apparatus>

Figure 12:
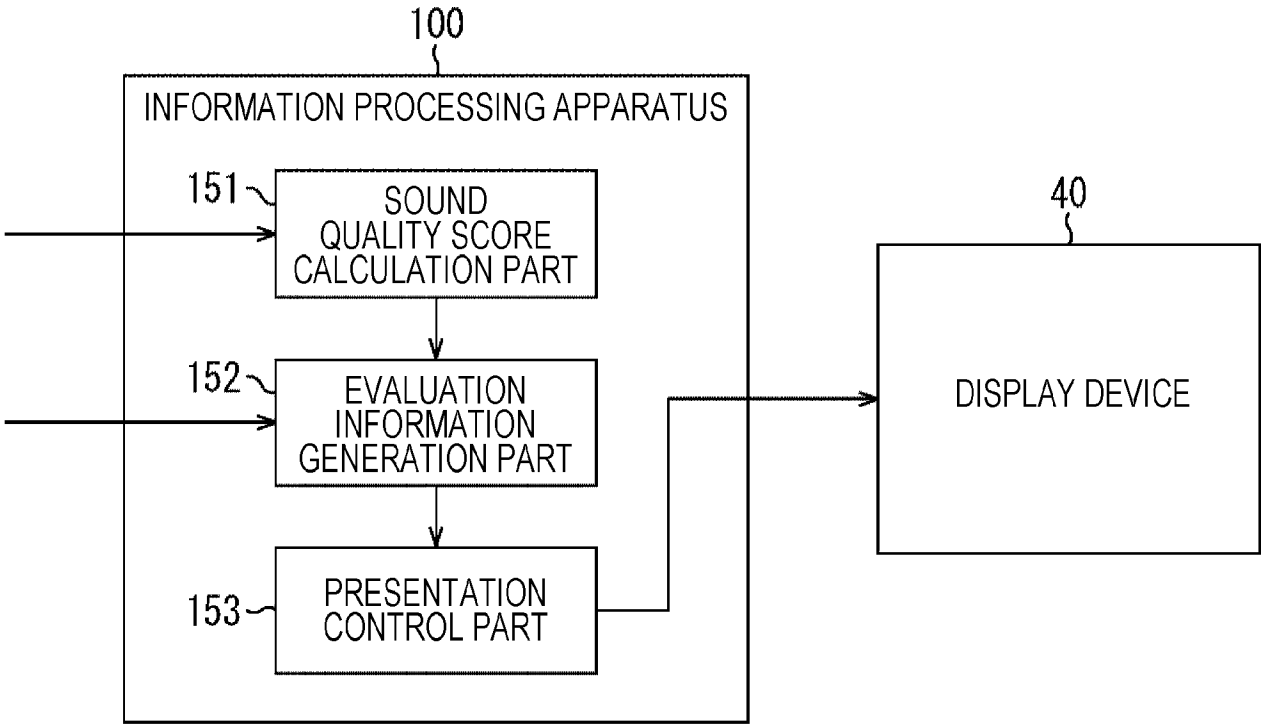
FIG. 12 is a block diagram showing an example of a configuration of an information processing apparatus to which the present technology is applied.

FIG. 12 is a block diagram showing an example of an information processing apparatus to which the present technology is applied.

An information processing apparatus 100 is a device for calculating and presenting a sound quality score as an index for evaluating whether or not the sound amplification sound volume is appropriate.

The information processing apparatus 100 calculates the sound quality score on the basis of the data for calculating the sound quality score (hereinafter, referred to as score calculation data). Furthermore, the information processing apparatus 100 generates evaluation information on the basis of data for generating evaluation information (hereinafter, referred to as evaluation information generation data) and presents the evaluation information on the display device 40. Note that the evaluation information generation data includes, for example, the calculated sound quality score, and information obtained when performing off-microphone sound amplification, such as installation information of the speaker 20.

The display device 40 is, for example, a device having a display such as a liquid crystal display (LCD) or an organic light emitting diode (OLED). The display device 40 presents the evaluation information output from the information processing apparatus 100.

Note that the information processing apparatus 100 may be configured as, for example, an acoustic device that constitutes a sound amplification system, a dedicated measurement device, or a single electronic device such as a personal computer, of course, and also may be configured as a part of a function of the above-described electronic device such as the sound processing device 1, the microphone 10, and the speaker 20. Furthermore, the information processing apparatus 100 and the display device 40 may be integrated and configured as one electronic device.

In FIG. 12, the information processing apparatus 100 includes a sound quality score calculation part 151, an evaluation information generation part 152, and a presentation control part 153.

The sound quality score calculation part 151 calculates a sound quality score on the basis of the score calculation data input thereto, and supplies the sound quality score to the evaluation information generation part 152.

The evaluation information generation part 152 generates evaluation information on the basis of the evaluation information generation data (for example, sound quality score, installation information of the speaker 20, or the like) input thereto, and supplies the evaluation information to the presentation control part 153. For example, this evaluation information includes a sound quality score at the time of off-microphone sound amplification, a message according to the sound quality score, and the like.

The presentation control part 153 performs control of presenting the evaluation information supplied from the evaluation information generation part 152 on the screen of the display device 40.

Figure 13:
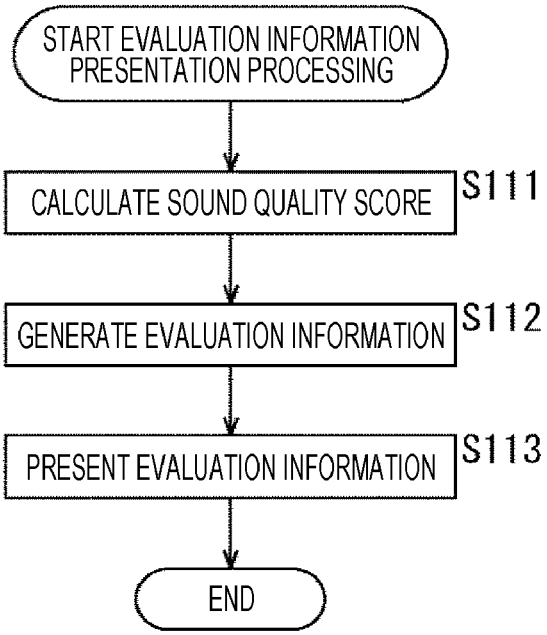
FIG. 13 is a flowchart for explaining the flow of evaluation information presentation processing.

In the information processing apparatus 100 configured as described above, the evaluation information presentation processing as shown in the flowchart of FIG. 13 is performed.

In step S111, the sound quality score calculation part 151 calculates the sound quality score on the basis of the score calculation data.

This sound quality score can be obtained, for example, as shown in following Formula (1), by the product of the sound sneaking amount at the time of calibration and the beamforming suppression amount.

$$\text{Sound quality score} = \text{sound sneaking amount} \times \text{beamforming suppression amount} \quad (1)$$

Here, FIG. 14 shows an example of calculation of the sound quality score. In FIG. 14, the sound quality score is calculated for each of the four cases A to D.

In case A, since the sound sneaking amount of 6 dB and the beamforming suppression amount of −12 dB are obtained, it is possible to obtain the sound quality score of −6 dB by calculating Formula (1). Note that, in this example, since the unit is expressed in decibel, the multiplication is addition.

Similarly, in case B, the sound quality score of −12 dB is calculated from the sound sneaking amount of 6 dB and the beamforming suppression amount of −18 dB. Moreover, in case C, a sound quality score of −12 dB is calculated from the sound sneaking amount of 0 dB and the beamforming suppression amount of −12 dB, and in case D, the sound quality score of −18 dB is calculated from the sound sneaking amount of 0 dB and the beamforming suppression amount of −18 dB.

As described above, for example, in a case where the sound sneaking amount is large and the beamforming suppression amount is small, as in case A, the sound quality score is high, which corresponds to poor sound quality. On the other hand, for example, in a case where the sound sneaking amount is small and the beamforming suppression amount is large, as in case D, the sound quality score is low, which corresponds to preferable sound quality. Furthermore, in this example, the sound quality scores of cases B and C are between the sound quality scores of cases A and D, so that the sound quality of cases B and C is equivalent to the middle sound quality (medium sound quality) of the cases A and D.

Note that, here, an example of calculating the sound quality score using Formula (1) has been shown, but this sound quality score is an example of an index for evaluating whether or not the sound amplification sound volume is appropriate, and other index may be used. For example, any score may be used as long as it can show the current situation in the trade-off relationship between the sound amplification sound volume and the sound quality, such as a score obtained by calculating the sound quality score for each band. Furthermore, the three-stage evaluation of high sound quality, medium sound quality, and low sound quality is an example, and for example, the evaluation may be performed in two stages or four or more stages by threshold value judgment.

Returning to FIG. 13, in step S112, the evaluation information generation part 152 generates evaluation information on the basis of the evaluation information generation data including the sound quality score calculated by the sound quality score calculation part 151.

In step S113, the presentation control part 153 presents the evaluation information generated by the evaluation information generation part 152 on the screen of the display device 40.

Here, FIGS. 15 to 18 show examples of presentation of evaluation information.

(Presentation in Case of High Sound Quality)

Figure 15:
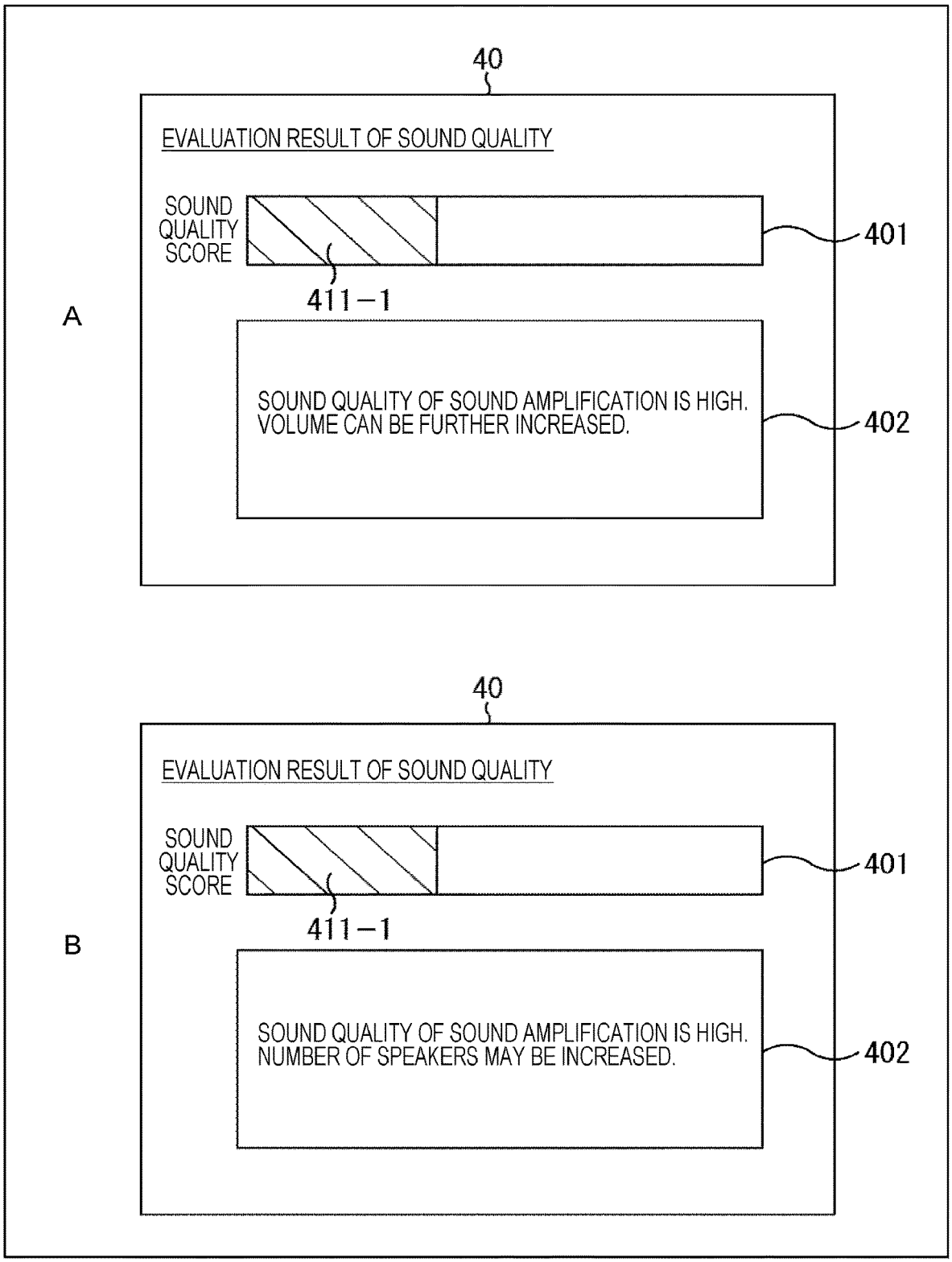
FIG. 15 is a diagram showing a first example of presentation of evaluation information.

FIG. 15 shows an example of presentation of the evaluation information in a case where the sound quality is evaluated to be preferable by the sound quality score. As shown in FIG. 15, on the screen of the display device 40, a level bar 401 showing the state of the amplification sound in three stages according to the sound quality score, and a message area 402 displaying a message regarding the state are displayed. Note that, in the level bar 401, the left end in the drawing represents the minimum value of the sound quality score, and the right end in the drawing represents the maximum value of the sound quality score.

In the example of A of FIG. 15, since the sound quality of the amplification sound is in a high sound quality state, in the level bar 401, a first-stage level 411-1 (for example, green bar) having a predetermined ratio (first ratio) according to the sound quality score is presented. Furthermore, in the message area 402, a message of "Sound quality of sound amplification is high. Volume can be further increased." is presented.

Furthermore, as another example of the presentation in a case of high sound quality, in the example of B of FIG. 15, a message of "Sound quality of sound amplification is high. Number of speakers may be increased." is presented in the message area 402.

Therefore, a user such as an installer of the microphone 10 or the speaker 20 can check the level bar 401 or the message area 402 to recognize that the sound quality of the sound amplification is high, the volume can be increased, or the number of the speakers 20 can be increased at the time of off-microphone sound amplification, and can take measures (for example, adjusting the volume, adjusting the number and orientation of the speakers 20, or the like) according to the recognition result.

(Presentation in Case of Medium Sound Quality)

Figure 16:
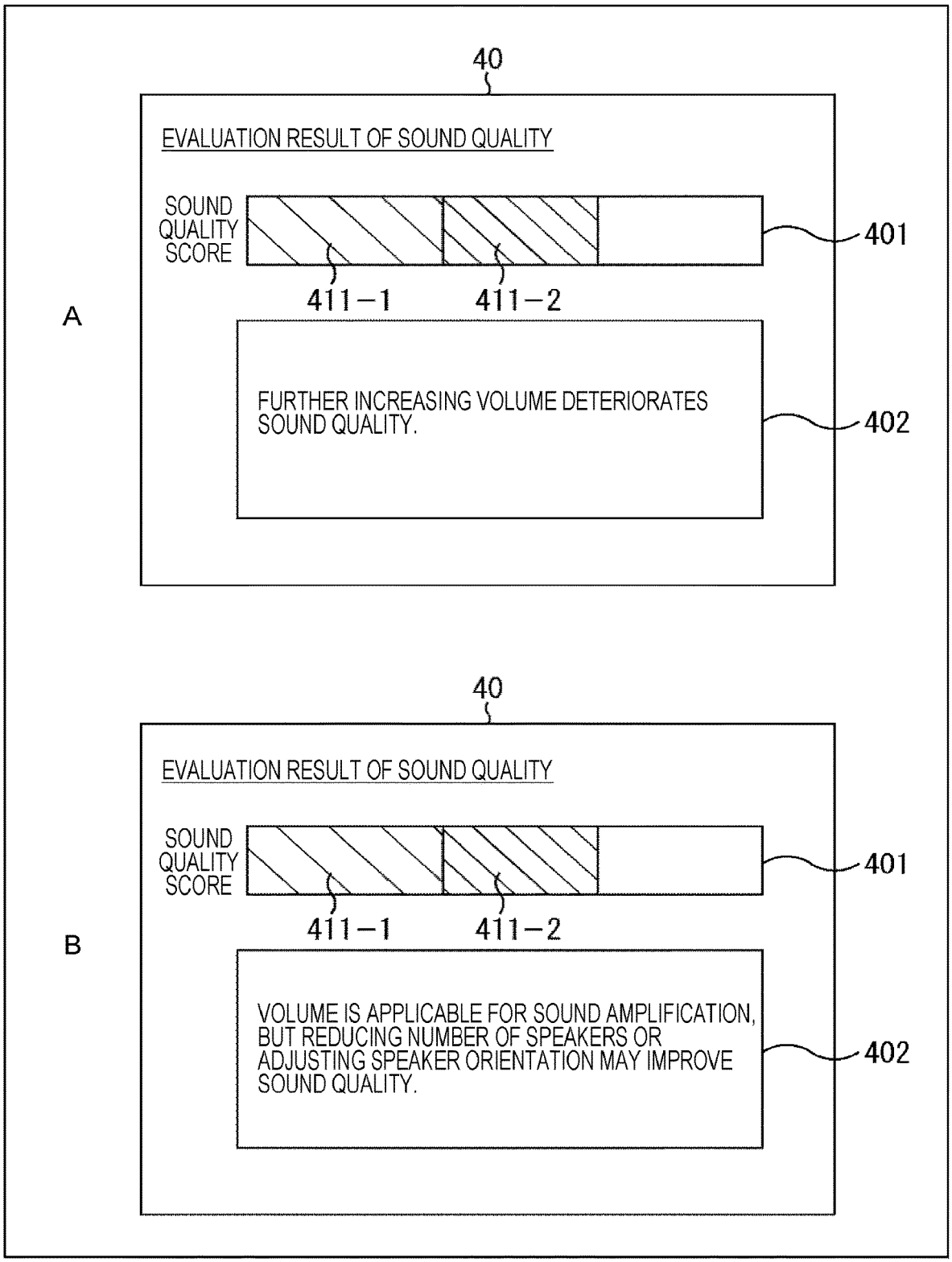
FIG. 16 is a diagram showing a second example of presentation of evaluation information.

FIG. 16 shows an example of presentation of the evaluation information in a case where the sound quality is evaluated to be a medium sound quality by the sound quality score. In FIG. 16, as similar to FIG. 15, the level bar 401 and the message area 402 are displayed on the screen of the display device 40.

In the example of A of FIG. 16, since the sound quality of the amplification sound is in a medium sound quality state, in the level bar 401, a first-stage level 411-1 (for example, green bar) and a second-stage level 411-2 (for example, yellow bar) having a predetermined ratio (second ratio: second ratio>first ratio) according to the sound quality score are presented. Furthermore, in the message area 402, a message of "further increasing volume deteriorates sound quality." is presented.

Furthermore, as another example of presentation in a case of medium sound quality, in the example of B of FIG. 16, in the message area 402, "Volume is applicable for sound amplification, but reducing number of speakers or adjusting speaker orientation may improve sound quality." is presented.

Therefore, the user can check the level bar 401 or the message area 402 to recognize that, at the time of off-microphone sound amplification, the sound quality of the sound amplification is the medium sound quality, it is difficult to increase the volume any more, or the sound quality may be improved by reducing the number of the speakers 20 or adjusting the orientation of the speaker 20, and can take measures according to the recognition result.

(Presentation in Case of Low Sound Quality)

Figure 17:
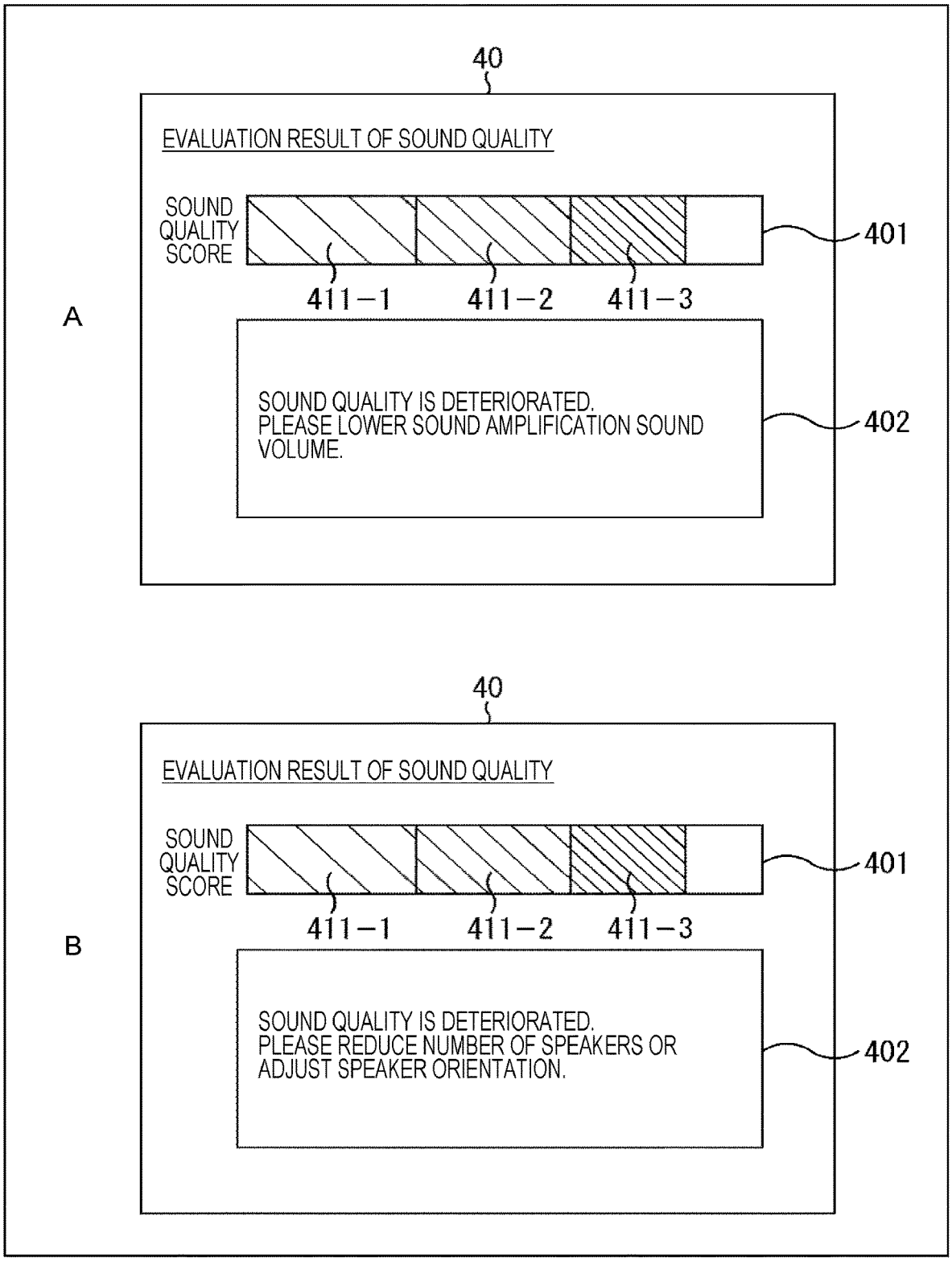
FIG. 17 is a diagram showing a third example of presentation of evaluation information.

FIG. 17 shows an example of presentation of the evaluation information in a case where the sound quality is evaluated to be poor by the sound quality score. In FIG. 17, as similar to FIGS. 15 and 16, the level bar 401 and the message area 402 are displayed on the screen of the display device 40.

In the example of A of FIG. 17, since the sound quality of the amplification sound is in a poor sound quality state, in the level bar 401, a first-stage level 411-1 (for example, green bar), a second-stage level 411-2 (for example, yellow bar), and a third-stage level 411-3 (for example, red bar) having a predetermined ratio (third ratio:third ratio>second ratio) according to the sound quality score are presented. Furthermore, in message area 402, a message of "Sound quality is deteriorated. Please lower sound amplification sound volume." is presented.

Furthermore, as another example of the presentation in a case of medium sound quality, in the example of B of FIG. 17, in the message area 402, "Sound quality is deteriorated. Please reduce number of speakers or adjust speaker orientation." is presented.

Therefore, the user can check the level bar 401 or the message area 402 to recognize that, at the time of off-microphone sound amplification, the sound quality of the sound amplification is the low sound quality, the sound amplification sound volume needs to be lowered, or it is required to reduce the number of the speakers 20 or adjust the orientation of the speaker 20, and can take measures according to the recognition result.

(Transition of Sound Quality Evaluation Results at the Time of Adjustment)

Figure 18:
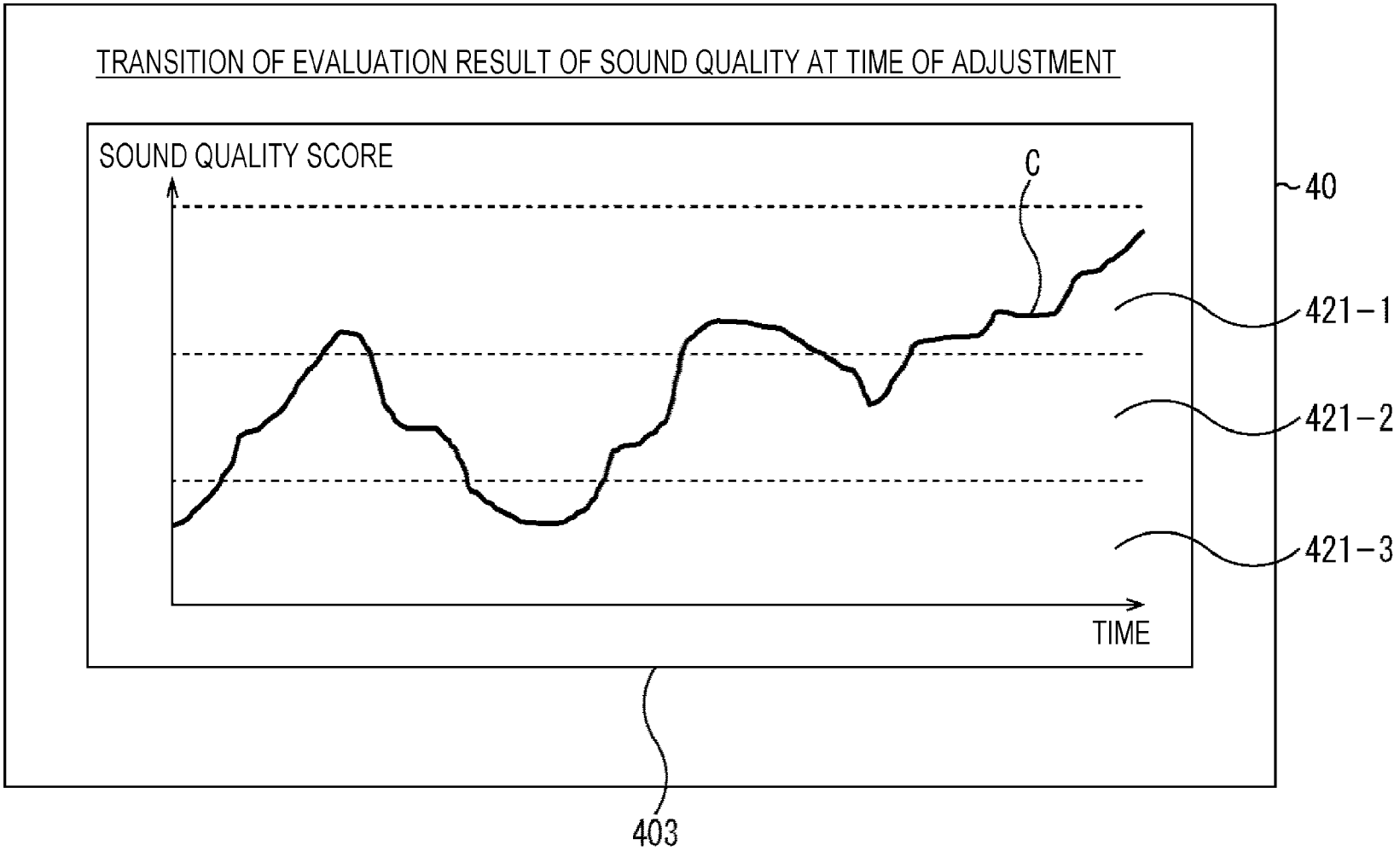
FIG. 18 is a diagram showing a fourth example of presentation of evaluation information.

FIG. 18 shows an example of presentation of evaluation information in a case where adjustment is performed by the user.

As shown in FIG. 18, on the screen of the display device 40, a graph area 403 for displaying a graph showing a temporal change of the sound quality score at the time of adjustment is displayed. In this graph area 403, the vertical axis represents the sound quality score, and means that the value of the sound quality score increases toward the upper side in the drawing. Furthermore, the horizontal axis represents time, and the direction of time is from the left side to the right side in the drawing.

Here, the adjustment performed at the time of adjustment also includes, for example, adjustment of the speaker 20 such as adjustment of the number of speakers 20 installed for the microphone 10, or adjustment of the orientation of the speaker 20, in addition to adjustment of the sound amplification sound volume. By performing such adjustment, in the graph area 403, the value indicated by the curve C indicating the value of the sound quality score for each time changes with time.

For example, in the graph area 403, the vertical axis direction is divided into three stages according to the sound quality score. In a case where the sound quality score indicated by the curve C is in a region 421-1 of the first stage, this indicates that the sound quality of the amplification sound is in the high sound quality state. Furthermore, in a case where the sound quality score indicated by the curve C is in a region 421-2 of the second stage, this indicates that the sound quality of the amplification sound is in the middle sound quality state, and in a case where the sound quality score is in a region 421-3 of the third stage, this indicates that the sound quality of the amplification sound is in the low sound quality state.

Therefore, at the time of adjustment of the volume of the amplification sound or the speaker 20, the user can check the transition of the evaluation result of the sound quality to intuitively recognize the improvement effect of the adjustment. Specifically, in the graph area 403, if the value indicated by the curve C changes from within the region 421-3 of the third stage to within the region 421-1 of the first stage, this means that an improvement in sound quality can be seen.

Note that the example of presentation of the evaluation information shown in FIGS. 15 to 18 is an example, and the evaluation information may be presented by another user interface. For example, another method can be used as long as it is a method capable of presenting evaluation information such as a lighting pattern of a light emitting diode (LED) and sound output.

Returning to FIG. 13, when the processing of step S113 ends, the evaluation information presentation process ends.

The flow of the evaluation information presentation processing has been described above. In this evaluation information presentation processing, at the time of the off-microphone sound amplification, the evaluation information indicating whether or not the sound amplification sound volume is appropriate is presented in consideration of the relationship between the amplification sound and the sound quality, so that the user such as an installer of the microphone 10 or the speaker 20 can determine whether or not the current adjustment is appropriate. Therefore, the user can perform operation according to the intended use while balancing the sound volume and the sound quality.

Note that, in above-described Patent Document 2, although the sound signals output from different series are separated in the communication device, in this separation of the sound signal, the sound signals are originally different, and are entirely different from the sound signals that are originally the same as the recording sound signal and the amplification sound signal shown in the above-described first to sixth embodiments.

In other words, the technology disclosed in Patent Document 2 is that "the sound signal transmitted from the room of the other party is output from the speaker of the own room, and the sound signal obtained in the own room is transmitted to the room of the other party". On the other hand, the present technology is "to perform sound amplification on a sound signal obtained in the own room by a speaker in that room (own room), and at the same time, record the sound signal in a recorder or the like. Then, in the present technology, the amplification sound signal to be subjected to sound amplification by a speaker and a recording sound signal to be recorded in a recorder or the like are sound signals that are originally the same, but are made to be sound signals adapted to the intended use by different tuning or parameters, for example.

2. Modification

Note that, in the above description, the sound processing device 1 includes the A/D conversion part 12, the signal processing part 13, the recording sound signal output part 14, and the amplification sound signal output part 15. However, the signal processing part 13 and the like may be included in the microphone 10, the speaker 20, and the like. That is, in a case where the sound amplification system is configured by devices such as the microphone 10, the speaker 20, and the recording device 30, the signal processing part 13 and the like can be included in any device that is included in the sound amplification system.

In other words, the sound processing device 1 may be configured as a dedicated sound processing device that performs signal processing such as beamforming processing and howling suppression processing, and also may be incorporated in the microphone 10 or the speaker 20, for example, as a sound processing part (sound processing circuit).

Furthermore, in the above description, the recording series and the amplification series have been described as the series to be subjected to different signal processing. However, by providing a series other than the recording series and the amplification series, and tuning (parameter setting) adapted to the other series may be performed.

3. Computer Configuration

Figure 19:
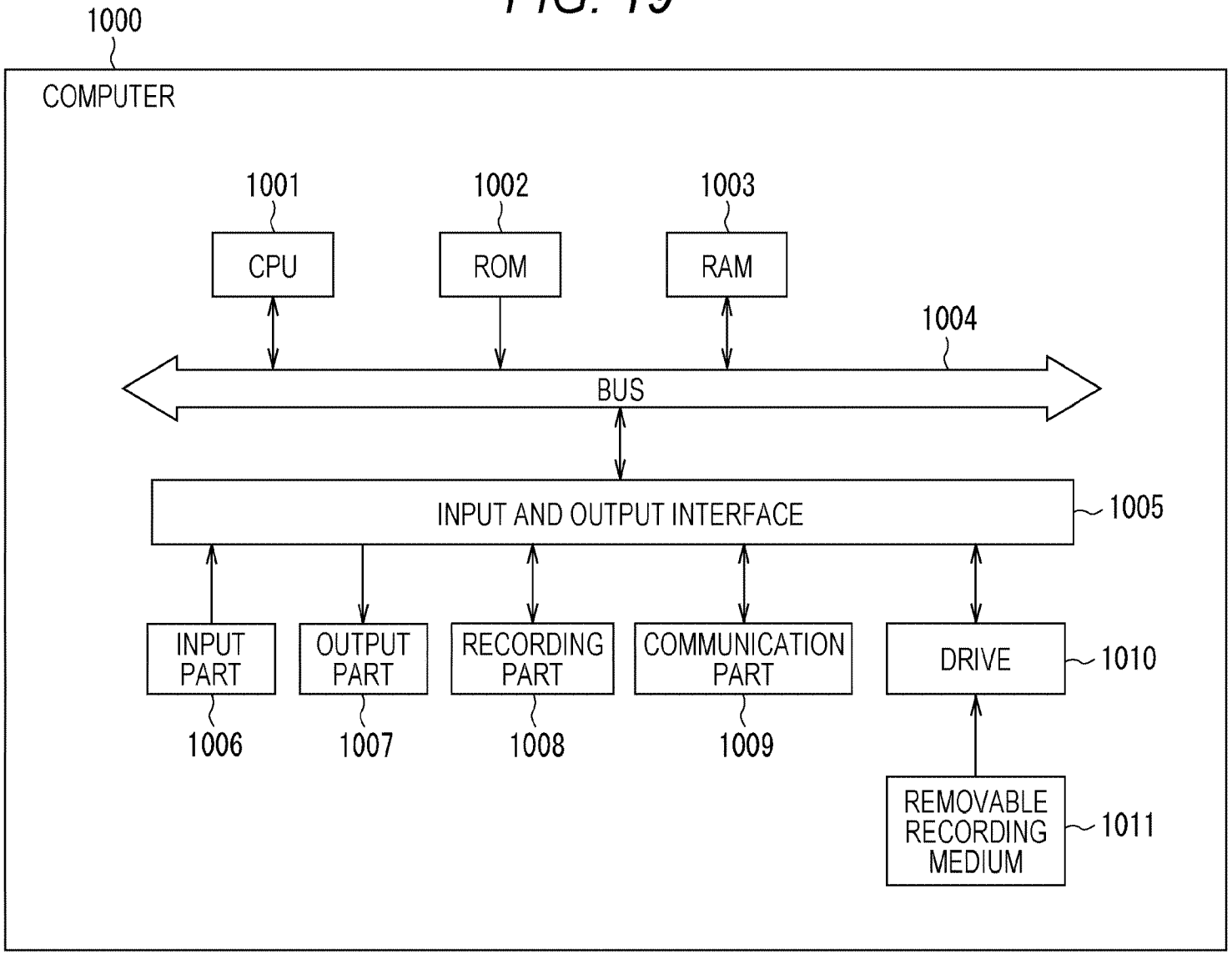
FIG. 19 is a diagram showing an example of a configuration of hardware of a computer.

The series of processing described above can be also performed by hardware or can be performed by software. In a case where a series of processing is executed by software, a program constituting the software is installed in a computer of each device. FIG. 19 is a block diagram showing an example of a hardware configuration of a computer that executes the above-described series of processes (for example, the signal processing shown in FIGS. 4, 6, and 8 and the presentation processing shown in FIG. 13) by a program.

In a computer 1000, a central processing unit (CPU) 1001, a read only memory (ROM) 1002, and a random access memory (RAM) 1003 are mutually connected by a bus 1004. An input and output interface 1005 is further connected to the bus 1004. An input part 1006, an output part 1007, a recording part 1008, a communication part 1009, and a drive 1010 are connected to the input and output interface 1005.

The input part 1006 includes a microphone, a keyboard, a mouse, and the like. The output part 1007 includes a speaker, a display, and the like. The recording part 1008 includes a hard disk, a nonvolatile memory, and the like. The communication part 1009 includes a network interface and the like. The drive 1010 drives a removable recording medium 1011 such as a magnetic disk, an optical disk, a magneto-optical disk, or a semiconductor memory.

In the computer 1000 configured as described above, the CPU 1001 loads the program recorded in the ROM 1002 or the recording part 1008 into the RAM 1003 via the input and output interface 1005 and the bus 1004, and executes the program, so that the above-described series of processing is performed.

The program executed by the computer 1000 (CPU 1001) can be provided by being recorded on the recording medium 1011 as a package medium or the like, for example. Furthermore, the program can be provided via a wired or wireless transmission medium such as a local area network, the Internet, or digital satellite broadcasting.

In the computer 1000, a program can be installed in the recording part 1008 via the input and output interface 1005 by mounting the recording medium 1011 to the drive 1010. Furthermore, the program can be received by the communication part 1009 via a wired or wireless transmission medium and installed in the recording part 1008. In addition, the program can be installed in the ROM 1002 or the recording part 1008 in advance.

Here, in the present specification, processing performed by a computer according to a program does not necessarily need to be performed in a time series in the order described in the flowchart. That is, the processing performed by the computer according to the program also includes processing executed in parallel or individually (for example, parallel processing or processing by an object). Furthermore, the program may be processed by one computer (processor) or processed by a plurality of computers in a distributed manner.

Note that the embodiments of the present technology are not limited to the above-described embodiments, and various modifications are possible without departing from the gist of the present technology.

Furthermore, each step of the above-described signal processing can be executed by one device or shared and executed by a plurality of devices. Moreover, in a case where a plurality of processes is included in one step, a plurality of processes included in the one step can be executed by one device or shared and executed by a plurality of devices.

Note that, the present technology can also adopt the following configuration.

(1)

A sound processing device including a signal processing part that processes a sound signal picked up by a microphone, and generates a recording sound signal to be recorded in a recording device and an amplification sound signal different from the recording sound signal to be output from a speaker.

(2)

The sound processing device according to (1) above, in which the signal processing part performs first processing for reducing sensitivity in an installation direction of the speaker, as directivity of the microphone.

(3)

The sound processing device according to (2) above, in which the signal processing part performs second processing for suppressing howling on the basis of a first sound signal obtained by the first processing.

(4)

The sound processing device according to (3) above, in which the recording sound signal is the first sound signal, and the amplification sound signal is a second sound signal obtained by the second processing.

(5)

The sound processing device according to any one of (2) to (4) above, in which the signal processing part learns parameters used in the first processing, and performs the first processing on the basis of the parameters that have been learned.

(6)

The sound processing device according to (5) above, further including a first generation part that generates calibration sound, in which, in a calibration period in which the parameters are adjusted, the microphone picks up the calibration sound output from the speaker, and the signal processing part learns the parameters on the basis of the calibration sound that has been picked up.

(7)

The sound processing device according to (5) or (6) above, further including a first generation part that generates predetermined sound, in which in a period before start of sound amplification using the amplification sound signal by the speaker, the microphone picks up the predetermined sound output from the speaker, and the signal processing part learns the parameters on the basis of the predetermined sound that has been picked up.

(8)

The sound processing device according to any one of (5) to (7) above, further including a noise adding part that adds noise to a masking band of the amplification sound signal when sound amplification using the amplification sound signal by the speaker is being performed, in which the microphone picks up sound output from the speaker, and the signal processing part learns the parameters on the basis of the noise obtained from the sound that has been picked up.

(9)

The sound processing device according to any one of (1) to (8) above, in which the signal processing part performs signal processing using parameters adapted to each series of a first series in which signal processing for the recording sound signal is performed, and a second series in which signal processing for the amplification sound signal is performed.

(10)

The sound processing device according to any one of (1) to (9) above, further including:

a second generation part that generates evaluation information including an evaluation regarding sound quality at the time of sound amplification on the basis of information obtained when performing the sound amplification using the amplification sound signal by the speaker; and a presentation control part that controls presentation of the evaluation information that has been generated.

(11)

The sound processing device according to (10) above, in which the evaluation information includes a sound quality score at the time of sound amplification and a message according to the score.

(12)

The sound processing device according to any one of (1) to (11) above, in which the microphone is installed away from a speaking person's mouth.

(13)

The sound processing device according to any one of (3) to (8) above, in which the signal processing part includes:

a beamforming processing part that performs beamforming processing as the first processing; and a howling suppression processing part that performs howling suppression processing as the second processing.

(14)

A sound processing method of a sound processing device, in which the sound processing device processes a sound signal picked up by a microphone, and generates a recording sound signal to be recorded in a recording device and an amplification sound signal different from the recording sound signal to be output from a speaker.

(15)

A program for causing a computer to function as a signal processing part that processes a sound signal picked up by a microphone, and generates a recording sound signal to be recorded in a recording device and an amplification sound signal different from the recording sound signal to be output from a speaker.

(16)

A sound processing device including a signal processing part that performs processing for, when processing a sound signal picked up by a microphone and outputting the sound signal from a speaker, reducing sensitivity in an installation direction of the speaker as directivity of the microphone.

(17)

The sound processing device according to (16) above, further including a generation part that generates calibration sound, in which, in a calibration period in which parameters to be used in the processing are adjusted, the microphone picks up the calibration sound output from the speaker, and the signal processing part learns the parameters on the basis of the calibration sound that has been picked up.

(18)

The sound processing device according to (16) or (17) above, further including a generation part that generates predetermined sound, in which, in a period before start of sound amplification using the sound signal by the speaker, the microphone picks up the predetermined sound output from the speaker, and the signal processing part learns parameters to be used in the processing on the basis of the predetermined sound that has been picked up.

(19)

The sound processing device according to any one of (16) to (18) above, further including a noise adding part that adds noise to a masking band of the sound signal when sound amplification using the sound signal by the speaker is being performed, in which the microphone picks up sound output from the speaker, and the signal processing part learns parameters to be used in the processing on the basis of the noise obtained from the sound that has been picked up.

(20)

The sound processing device according to any one of (16) to (19) above, in which the microphone is installed away from a speaking person's mouth.

REFERENCE SIGNS LIST

1, 1A, 1B, 1C, 1D, 1E Sound processing device
10 Microphone
11-1 to 11-N Microphone unit
12-1 to 12-N A/D conversion part
13, 13A, 13B, 13C, 13D, 13E Signal processing part
14 Recording sound signal output part
15 Amplification sound signal output part
20 Speaker
30 Recording device
40 Display device
100 Information processing apparatus
101, 101-1, 101-2 Beamforming processing part
102 Howling suppression processing part
103-1, 103-2 Noise suppression part
104-1, 104-2 Reverberation suppression part
105-1, 105-2 Sound quality adjustment part
106-1, 106-2 Volume adjustment part
111 Calibration signal generation part
112 Masking noise adding part
121 Parameter learning part
131 Howling suppression part
151 Sound quality score calculation part
152 Evaluation information generation part
153 Presentation control part
1000 Computer
1001 CPU

The invention claimed is:

1. A sound processing device, comprising:

signal processing circuitry configured to process a sound signal picked up by a microphone, and generate a recording sound signal to be recorded in a recording device and an amplification sound signal, different from the recording sound signal, to be output from a speaker, wherein the signal processing circuitry is further configured to perform first processing to form directivity that reduces sensitivity in an installation direction of the speaker, and perform second processing to suppress howling based on a first sound signal obtained by the first processing.

2. The sound processing device according to claim 1, wherein the recording sound signal generated by the signal processing circuitry is the first sound signal, and the amplification sound signal generated by the signal processing circuitry is a second sound signal obtained by the second processing.

3. The sound processing device according to claim 1, wherein the signal processing circuitry is further configured to learn parameters used in the first processing, and perform the first processing based on the parameters that have been learned.

4. The sound processing device according to claim 3, wherein the signal processing circuitry is further configured to generate calibration sound, wherein, in a calibration period in which the parameters are adjusted, the microphone picks up the calibration sound output from the speaker, and the signal processing circuitry is configured to learn the parameters based on the calibration sound that has been picked up.

5. The sound processing device according to claim 3, wherein the signal processing circuitry is further configured to generate predetermined sound, wherein, in a period before a start of sound amplification using the amplification sound signal by the speaker, the microphone picks up the predetermined sound output from the speaker, and the signal processing circuitry is further configured to learn the parameters based on the predetermined sound that has been picked up.

6. The sound processing device according to claim 3, wherein the signal processing circuitry is further configured to add noise to a masking band of the amplification sound signal when sound amplification using the amplification sound signal by the speaker is being performed, wherein the microphone picks up sound output from the speaker, and the signal processing circuitry is further configured to learn the parameters based on the noise obtained from the sound that has been picked up.

7. The sound processing device according to claim 1, wherein the signal processing circuitry is further configured to perform signal processing using parameters adapted to each series of a first series in which signal processing for the recording sound signal is performed, and a second series in which signal processing for the amplification sound signal is performed.

8. The sound processing device according to claim 1, further comprising:

circuitry configured to generate evaluation information including an evaluation regarding sound quality at a time of sound amplification based on information obtained when performing the sound amplification using the amplification sound signal by the speaker; and control presentation of the evaluation information that has been generated.

9. The sound processing device according to claim 8, wherein the evaluation information generated by the circuitry includes a sound quality score at a time of sound amplification and a message according to the score.

10. The sound processing device according to claim 1, wherein the microphone is installed away from a mouth of a speaking person.

11. The sound processing device according to claim 1, wherein the signal processing circuitry is further configured to perform beam arming processing as the first processing and perform howling suppression processing as the second processing.

12. A sound processing method of a sound processing device, the method comprising:

processing a sound signal picked up by a microphone to generate a recording sound signal to be recorded in a recording device and an amplification sound signal, different from the recording sound signal, to be output from a speaker, wherein the processing includes performing first processing to form directivity that reduces sensitivity in an installation direction of the speaker, and performing second processing to suppress howling based on a first sound signal obtained by the first processing.

13. A non-transitory computer-readable medium storing a program that, when executed by processing circuitry, causes the processing circuitry to:

process a sound signal picked up by a microphone, and generate a recording sound signal to be recorded in a recording device and an amplification sound signal, different from the recording sound signal, to be output from a speaker, and wherein the program further causes the processing circuitry to perform first processing to form directivity that reduces sensitivity in an installation direction of the speaker, and perform second processing to suppress howling based on a first sound signal obtained by the first processing.

14. A sound processing device, comprising signal processing circuitry configured to, when processing a sound signal picked up by a microphone and outputting the sound signal from a speaker, perform processing to form directivity that reduces sensitivity in an installation direction of the speaker, wherein the signal processing circuitry is further configured to learn parameters used in the processing based on sound picked up by the microphone during a predetermined period, the predetermined period being one of (1) a calibration period in which the parameters to be used in the processing are adjusted, and (2) a period before start of sound amplification.

15. The sound processing device according to claim 14, wherein the signal processing circuitry is further configured to generate calibration sound, wherein, in the calibration period, the microphone picks up the calibration sound output from the speaker, and the signal processing circuitry is further configured to learn the parameters based on the calibration sound that has been picked up.

16. The sound processing device according to claim 14, wherein the signal processing circuitry is further configured to generate predetermined sound, wherein, in the period before the start of the sound amplification using the sound signal by the speaker, the microphone picks up the predetermined sound output from the speaker, and the signal processing circuitry is further configured to learn the parameters to be used in the processing based on the predetermined sound that has been picked up.

17. The sound processing device according to claim 14, wherein the signal processing circuitry is further configured to add noise to a masking band of the sound signal when sound amplification using the sound signal by the speaker is being performed, wherein the microphone picks up sound output from the speaker, and the signal processing circuitry is further configured to learn the parameters to be used in the processing based on the noise obtained from the sound that has been picked up.

18. The sound processing device according to claim 14, wherein the microphone is installed away from a mouth of a speaking person.

* * * * *